US005156944A

United States Patent [19]

Inoie et al.

[11] Patent Number: 5,156,944

[45] Date of Patent: * Oct. 20, 1992

[54] LIGHT-SENSITIVE SILVER HALIDE COLOR PHOTOGRAPHIC MATERIAL HAVING CROSS-EMULSION SENSITIVE DIR COMPOUNDS

[75] Inventors: Hiroshi Inoie; Minoru Ishikawa; Hiroshi Shimazaki; Katutoyo Suzuki; Fumio Hamada; Toshihiko Yagi, all of Hino, Japan

[73] Assignee: Konica Corporation, Tokyo, Japan

[ * ] Notice: The portion of the term of this patent subsequent to Feb. 16, 2005 has been disclaimed.

[21] Appl. No.: 559,974

[22] Filed: Jul. 27, 1990

Related U.S. Application Data

[63] Continuation of Ser. No. 284,760, Dec. 12, 1988, abandoned, which is a continuation of Ser. No. 110,556, Oct. 16, 1987, abandoned, which is a continuation-in-part of Ser. No. 901,784, Aug. 28, 1986, abandoned.

[30] Foreign Application Priority Data

Sep. 3, 1985 [JP] Japan ..... 60-194668
Jan. 31, 1986 [JP] Japan ..... 60-19526

[51] Int. Cl.[5] ..... G03C 7/305

[52] U.S. Cl. ..... 430/504; 430/505; 430/544; 430/567; 430/362

[58] Field of Search ..... 430/503, 505, 567, 544, 430/957, 362, 504, 506, 569

[56] References Cited

U.S. PATENT DOCUMENTS

| | | | |
|---|---|---|---|
| 4,184,877 | 1/1980 | Maternaghan | 430/567 |
| 4,184,878 | 1/1980 | Maternaghan | 430/567 |
| 4,414,306 | 11/1983 | Wey et al. | 430/567 |
| 4,421,845 | 12/1983 | Uemura et al. | 430/544 |
| 4,482,629 | 11/1984 | Nakagawa et al. | 430/544 |
| 4,546,073 | 10/1985 | Bergthaller et al. | 430/544 |
| 4,704,351 | 11/1987 | Takiguchi et al. | 430/567 |
| 4,725,529 | 2/1988 | Shimazaki et al. | 430/505 |
| 4,728,602 | 3/1988 | Shibahara et al. | 430/567 |

FOREIGN PATENT DOCUMENTS

| | | |
|---|---|---|
| 0070182 | 1/1983 | European Pat. Off. . |
| 0114675 | 8/1984 | European Pat. Off. . |
| 0115304 | 8/1984 | European Pat. Off. . |
| 0145460 | 12/1984 | European Pat. Off. . |
| 2354574 | 1/1976 | France . |
| 2010818 | 7/1979 | United Kingdom . |
| 2070266 | 9/1981 | United Kingdom . |

OTHER PUBLICATIONS

J54/048521, Abstract only, Apr. 17, 1979, Japan.

*Primary Examiner*—Lee C. Wr.ght
*Attorney, Agent, or Firm*—Frishauf, Holtz, Goodman & Woodward

[57] ABSTRACT

There is disclosed a light-sensitive silver halide photographic material, having two or more light-sensitive silver halide emulsion layers different in color sensitivities on a support, at least one of the light-sensitive silver halide emulsion layer comprises monodispersed silver halide grains containing 8 to 30 mole % of silver halide in core or contains twinned crystal silver halide grains, at least two of the light-sensitive silver halide emulsion layers different in color sensitivities containing a DIR compound capable of releasing a developing inhibitor or developing inhibitor precursor through the reaction with the oxidized product of a developing agent, the developing inhibitor or developing inhibitor precursor released from the DIR compound being diffusive, wherein the following conditions A:

DIR compounds are added and incorporated in the emulsion layers so that the developing inhibitor released from the DIR compound incorporated in one color-sensitive silver halide emulsion layer and the developing inhibitor released from the DIR compound incorporated in the other color-sensitive silver halide emulsion layer are reversed in developing inhibiting power when the DIR compounds to be incorporated in the respective light-sensitive silver halide emulsion layers are exchanged with each other, and also each DIR compound may have greater inhibiting power for the other light-sensitive silver halide emulsion layer rather than for the light-sensitive silver halide emulsion layer in which it is incorporated, is satisfied for the at least two light-sensitive silver halide emulsion layers different in color sensitivities.

14 Claims, No Drawings

LIGHT-SENSITIVE SILVER HALIDE COLOR PHOTOGRAPHIC MATERIAL HAVING CROSS-EMULSION SENSITIVE DIR COMPOUNDS

This application is a continuation of application Ser. No. 07/284,760, filed Dec. 12, 1988 (abandoned) which is a continuation Ser. No. 07/110,556 filed Oct. 16, 1987 (abandoned), which is a continuation in part of Ser. No. 06/901,784 field Aug. 28, 1986 (abandoned).

BACKGROUND OF THE INVENTION

This invention relates to a light-sensitive silver halide color photographic material, more specifically to a light-sensitive silver halide photographic material more emphasized in the inter-image effect (interlayer effect, hereinafter called I.I.E.), improved in color reproducibility, sharpness and graininess thereby and further excellent in stability with the lapse of time, particularly excellent in stability under high temperature and high humidity.

In general, to the light-sensitive silver halide color photographic material, it is required the photographic characteristics of being smoothness and not rough in light and shade of subject groups for forming images, i.e., being good in graininess; or being sharp in contours of an image and to be drawn a fine image without fade, i.e., being good in sharpness, etc. In recent years, accompanying to the high sensitization of the color photographic material and miniaturization of a camera, these requirements have increasingly been heightened. Of these, requirement to color reproducibility has particularly been heightened. Also, requirements to quality stabilization have increasingly been heightened with the spread of compact laboratory and automatic printer.

The techniques for improving color reproducibility by emphasizing I.I.E. with the use of DIR couplers have been known, and various compounds are used as these DIR compounds. For example, there may be included the so-called DIR couplers which form color forming dyes through the oxidized product of a color developing agent simultaneously with release of a developing inhibitor during development, the so-called DIR substances which release a developing inhibitor through the reaction with the oxidized product of a color developing agent but do not form a color forming dye, those which can release directly or indirectly a developing inhibitor through the reaction with the oxidized product of a color developing agent as disclosed in Japanese Provisional Patent Publications No. 145135/1979, No. 154234/1982, No. 162949/1983, No. 205150/1983, No. 195643/1984, No. 206834/1984, No. 206836/1984, No. 210440/1984 and No. 7429/1985 (hereinafter called timing DIR compounds). In the present specification, those exhibiting the above DIR effect are called comprehensively as the DIR compounds.

When these DIR compounds are used in light-sensitive silver halide color materials, developing inhibitors can be released from DIR compounds during development to obtain the effect of inhibiting development in other silver halide emulsion layers, namely I.I.E. Particularly, DIR compounds capable of releasing the so-called diffusive inhibiting groups or diffusive developing inhibitor precursors are effective. They have been used for silver halide color films in these days to give some effects. However, due to strong directional tendency of I.I.E. (for example, strong in the direction from a blue-sensitive silver halide emulsion layer to a green-sensitive silver halide emulsion layer, but weak in the opposite direction), although improvement of saturation (chroma) of a specific color may be expected, an undesirable effect of "dislocation in hue" is accompanied therewith. Also, with respect to diffusiveness, since the inhibiting effect acts most strongly on the added layer, and therefore problems are involved such as lowering in gamma ($\gamma$), lowering in sensitivity, lowering in color formed density, etc. Thus, it is difficult to use an amount which can give sufficient effects to other layers.

The techniques for emphasizing I.I.E. from $\varepsilon$ color-sensitive layer to a different color-sensitive layer with the use of the so-called diffusive DIR compound are disclosed in Japanese Patent Publication No. 47379/1980, Japanese Provisional Patent Publications No. 93344/1982, No. 56837/1982 and No. 131937/1984. Even by use of these techniques, only unsatisfactory improvement of color reproducibility can be expected under the present situation.

Also, in Japanese Patent Application No. 93411/1985 (which corresponds to our co-pending U.S. Ser. No. 854,141 and European Patent Application No. 86 303 155. 5), a technique in which a DIR compound is so contained as to become a development inhibiting power of a sensitive layer added therein a diffusive DIR is higher than a development inhibiting power to the other sensitive layers has been disclosed and while it is insufficient color reproducibility has been improved as compared with the prior art. However, when these DIR compound is employed, with a lapse of time under high temperature and high humidity, lowering in the maximum coloring density and lowering in sensitivity would be caused, and particularly in the color photographic material, suffering a slippage in color hue and it becomes serious problem in practical use.

SUMMARY OF THE INVENTION

Accordingly, a first technical task of the present invention is to improve color reproducibility, particularly reproduction of saturation (chroma), by making greater I.I.E. in both directions between different color-sensitive layers.

On the other hand, it has been known to improve sharpness of an image, when I.I.E. is created by use of the so-called diffusive DIR compound as disclosed in the above patent publications or specifications.

This is due to improvement of color contrast accompanied with I.I.E., which is the edge effect between layers in addition to the edge effect in the added layer.

Accordingly, a second technical task of the present invention is to improve sharpness of an image by emphasizing I.I.E. in both directions by use of a DIR compound according to a suitable method.

Further, a third technical task of the present invention is as described in the specification below to improve graininess by uniforming developability using substantially monodispersed core/shell type silver halide grains and whereby uniformizing a shape of a dye cloud to be formed.

Moreover, a fourth technical task of the present invention is to provide a light-sensitive silver halide color photographic material which is improved in color reproducibility by enlarging I.I.E. of both directions between different color sensitive layers and is excellent in storage stability, particularly excellent in stability at high temperature and high humidity.

The light-sensitive silver halide color photographic material of the present invention which solves the above technical tasks has two or more light-sensitive silver halide emulsion layers different in color sensitivities on a support, at least one of said light-sensitive silver halide emulsion layer comprises monodispersed silver halide grains containing 8 to 30 mole % of silver halide in core or contains twinned crystal silver halide grains, at least two of said light-sensitive silver halide emulsion layers different in color sensitivities containing a compound capable of releasing a developing inhibitor or developing inhibitor precursor through the reaction with the oxidized product of a developing agent (DIR compound), the developing inhibitor or developing inhibitor precursor released from said DIR compound being diffusive, wherein the following conditions A is satisfied for said light-sensitive silver halide photographic material:

condition A

DIR compounds are added and incorporated in the emulsion layers so that the developing inhibitor released from the DIR compound incorporated in one color-sensitive silver halide emulsion layer and the developing inhibitor released from the DIR compound incorporated in the other color-sensitive silver halide emulsion layer are reversed in developing inhibiting power when said DIR compounds to be incorporated in the respective light-sensitive silver halide emulsion layers are exchanged with each other, and also each DIR compound may have greater inhibiting power for the other light-sensitive silver halide emulsion layer rather than for the light-sensitive silver halide emulsion layer in which it is incorporated.

DESCRIPTION OF THE PREFERRED EMBODIMENTS

In the following, the present invention will be explained in more detail.

In this invention, the monodispersed silver halide grains mean grains in which a weight of the silver halide grains each having an average diameter $\bar{r}$ and diameters within the range of ±20% of the average diameter $\bar{r}$ occupies 60% or more of the total weight of the silver halide grains. The above-mentioned average diameter $\bar{r}$ can be defined as a grain diameter $r_i$ (significant figure=3 figures) at the time when a product $n_i \times r_i^3$ of a frequency $n_i$ of the grains each having the grain diameter $r_i$ and $r_i^3$ is at a maximum level.

The grain diameter referred to herein means a diameter of each grain when the silver halide grain is spherical, and a diameter obtained by converting a projected image of each grain into a circular image having the same area when it is not spherical. The grain diameter can be determined, for example, by enlarging each grain 10,000-fold to 50,000-fold with the aid of an electron microscope, photographing it, and measuring a diameter of the grain or an area of its projected image on the resultant print (The grains to be measured are selected at random as many as 1,000 or more.).

The above-mentioned passage "consist substantially of monodispersed silver halide grains" means that the silver halide emulsion of the grains having different diameters can be mixedly used subject to not impairing the effect of monodispersed properties and that the grains a grain diameter distribution curve of which has a plurality of modes can be included in this invention. With regard to a grain diameter distribution of the silver halide grains comprising the substantially monodispersed silver halide grains inclusive of such grains as mentioned above, a weight of the silver halide grains having the diameter of the above defined $\bar{r}$ and the diameters within the range of ±20% of the diameter $\bar{r}$ occupies 60% or more, preferably 70% or more, particularly preferably 80% or more, of the total weight of the grains.

As grains which may be contained in the above emulsion layer other than the monodispersed silver halide grains of the present invention, there may be mentioned, for example, silver halide grains contained in other silver halide emulsion having a different average grain diameter with the monodispersed silver halide grains of the present invention.

The monodispersed silver halide grain of the present invention preferably is a so-called core/shell type grain comprising two or more layers in which a silver iodide content is different, and an iodine content in the core being preferably within the range of 8 to 40 mole % and more preferably within the range of 8 to 30 mole %. The average diameter of the silver halide grains is preferably from 0.2 to 3 μm, more preferably from 0.3 to 0.7 μm. A silver iodide content in the shell is preferably from 0.1 to 6 mole %.

A transition of the silver iodide content from the core to the shell may be bounded sharply, but the silver iodide content preferably varies continuously and gradually instead of the sharp variation. The silver halide grain of this invention may take any shape of hexahedron, octahedron, tetradecahedron, plate or sphere, or may be in a combination of these shapes, but the preferable grains have hexahedron, octahedron and tetradecahedron. The monodispersed silver halide grains of this invention can be manufactured by means of a double jet method while a pAg is constantly maintained, and in this case, the grains each having a desired size can be prepared. In order to prepare the highly monodispersed silver halide grains, a method disclosed in Japanese Provisional Patent Publication No. 48521/1979 may be employed. For example, there may be manufactured by adding an aqueous potassium iodobromide-gelatin solution and an aqueous ammoniacal silver nitrate solution to an aqueous gelatin solution containing silver halide seed grains, while their addition rates are varied as functions of time. In this way, the highly monodispersed silver halide grains can be prepared by suitably selecting an addition rate, pH, pAg, temperature and the like.

In the core/shell type grains, the monodispersed silver halide rains prepared in the above-mentioned manner are employed as the cores, and for example, a soluble halide compound and a soluble silver salt solution are used in accordance with the double jet method to deposit shells on the cores, thereby forming the monodispersed core/shell silver halide grains. The monodispersed silver halide grains of this invention preferably are such core/shell type grains as mentioned above, but in the core/shell type grains, a thickness of each shell is preferably within the range of 0.01 to 0.1 μm. That is, from the viewpoint of photographic performance, the thickness of not less than 0.01 μm is preferred, while 0.1 μm or less is also preferred in order to take our the effects of the present invention sufficiently.

Methods for preparing the above-mentioned core/shell type silver halide grains are disclosed, for example, in West German Patent No. 1,169,290, British Patent No. 1,027,146, Japanese Provisional Patent Publication No. 154232/1982 and Japanese Patent Publication No. 1417/1976.

In a process for manufacturing the monodispersed silver halide grains of this invention, there may coexists, for example, a cadmium salt, a zinc salt, a lead salt, a thallium salt, an iridium salt or a complex salt thereof, a rhodium salt or a its complex salt.

The monodispersed silver halide grains of this invention constitute a silver halide emulsion together with a hydrophilic colloid binder (e.g., gelatin) and the like which are usually used in the art.

In the another aspect of the present invention, the twinned crystal silver halide grains of the present invention may preferably have an aspect ratio of 8:1 or less to 2:1 or more, more preferably 6:1 or less to 2:1 or more. In the present specification, the aspect ratio means a ratio of a diameter of grain:a thickness.

In this place, a diameter of the silver halide grain means a diameter of circle having an area equal to a projected area of the grain. In the present invention, the diameter of the twinned crystal silver halide grains is 0.2 to 5.0 μm, preferably 0.2 to 4.0 μm.

In general, when the twinned crystal silver halide grain is a twinned crystal having two parallel faces, a distance between the two parallel primary faces is the thickness.

As the silver halide composition of the twinned crystal grains according to the present invention, preferably employed are those composed of silver bromide and silver iodobromide, and silver iodobromide having the silver iodide content of 0 to 20 mole % is preferred, more preferably 2 to 18 mole %, and particularly preferably 2 to 15 mole %.

Further, the twinned crystal grains of the present invention may be polydispersed or monodispersed, but more preferably be monodispersed. And preferred monodispersed is that a weight of the silver halide grains contained in the range of ±20% with the center of an average diameter $\bar{r}$ occupies 60% or more of the total weight of the silver halide grains.

In the following in the present specification, the case where the occupied weight of the silver halide grains contained in the range of ±20% with the center of an average diameter $\bar{r}$ based on the total weight of the silver halide grains is called U value.

The emulsion comprising monodispersed twinned crystal grain can be prepared in reference to preparative methods disclosed in Japanese Provisional Patent Publications No. 39027/1976, No. 153428/1977, No. 118823/1979 and the like.

Further, as a preferable method for preparing an emulsion comprising monodispersed plate shaped grains, the method in which nuclear grains comprising multiple twinned crystals are physically ripening in the presence of a silver halide solvent in order to prepare seed units each comprising monodispersed spheres, and then the seeds are grown. As the more preferable method, by the presence of a tetrazaindene compound at the growing period of the plate shaped grains, proportion of the plate shaped grains can be heightened and the monodispersibility of the grains can be enhanced.

In the layer containing the twinned crystals employed in the present invention, the twinned crystals may preferably be present in the ratio of 40% by weight or more, more preferably 60% by weight or more based on the total silver halide grains presented in the layer.

The layer containing the twinned crystals to be used in the present invention may be contained in any layer when plural color sensitivity layers are present, but they may preferably be contained in the higher sensitivity layer since it is effective.

As the preparative method of the twinned crystals, various methods can be optionally combined to obtain the twinned crystals.

For example, they can be prepared by forming seed crystals in which twinned crystal grains are present in terms of weight 40% or more under the relatively higher pAg value atmosphere such as a pBr of 1.3 or less, and then adding silver and a halogen solution simultaneously while maintaining the pBr value at the same level to grow the seed crystals.

During the growing period of the grains, it is preferred to add silver and a halogen solution in order to avoid generation of new crystal nucleus.

The size of the twinned crystals can be regulated by controlling a temperature, selecting a kind or amount of a solvent, or controlling an addition speed of a silver salt and halides to be used during the growing period of the grains.

By using a silver halide solvent in accordance with the necessity during the preparation of the twinned crystals to be used in the present invention, grain sizes, shape of grains (an aspect ratio, etc.), grain size distribution and growing speed of the grains can be controlled. An amount of the solvent to be used may preferably be $10^{-3}$ to 1.0% by weight, particularly preferably $10^{-2}$ to $10^{-1}$% by weight based on a reaction solution.

For example, the grain size distribution can be monodispersified with the increase of the used amount of the solvent as well as the growing speed can be accelerated. On the other hand, there is a tendency to increase a thickness of the grain with the used amount of the solvent.

As the silver halide solvent to be frequently used, they may be mentioned, for example, ammonia, thioether, thiourea and the like. As the thioether, it can be referred to U.S. Pat. Nos. 3,271,157, 3,790,387, 3,574,628, etc.

In the present invention, during the preparation of the twinned crystals, the method in which an addition speed, an addition amount and an addition concentration of a silver salt solvent (e.g., an aqueous $AgNO_3$ solution) and a halide solution (e.g., an aqueous KBr solution) which are added thereto in order to accelerating the grain growth may preferably be employed.

The twinned crystals having an average aspect ratio of 8:1 or less in accordance with the present invention may be doped by various metallic salts or metallic complexes during silver halide precipitation forming period, or on or after grain growth period. For example, metallic salts or metallic complexes of gold, platinum, palladium, iridium, bismuth, cadmium, copper and the like, and a combination thereof can be applied thereto. Further, in the prepartive method of an emulsion containing the above grains, as the desalting means, the Noodel washing method, the dialysis method or the coagulation precipitation method which are usually employed for general solvents may optionally be employed.

In the following, the above [condition A] will be explained in more detail.

Ordinarily, when a DIR compound is used in a color-sensitive layer, even if the developing inhibitor or its precursor (hereinafter referred to as developing inhibitor inclusive of this precursor) may be diffusive, the added layer itself which is the releasing layer is most inhibited, and it is difficult to use a large amount of a DIR compound due to lowering in density and lowering in sensitivity.

When a DIR compound is used in a certain layer, the layer is subject to developing inhibiting power of a certain greatness by the developing inhibitor of the DIR compound in its own layer. For this reason, there occurs the phenomenon that the developing inhibiting effect by the developing inhibitor supplied from other layers cannot fully be exhibited. In other words, when I.I.E. in both directions is desired to be formed between the two color-sensitive layers, both I.I.E become lower levels or only one direction becomes strong, while the other direction markedly weak.

However, it has been clarified as the result of the study by the present inventors (see Japanese Patent Application No. 93411/1985 which corresponds to our co-pending U.S. Ser. No. 854,141 or European Patent Application No. 86 303 155.5) that the developing inhibitor releases exhibits different developing inhibiting powers in different color-sensitive layers and also that there is difference in the manner in which the developing inhibiting powers differ depending on the kind of said developing inhibitor.

For example, when a developing inhibitor A and a developing inhibitor B are used in equal moles in a green-sensitive silver halide emulsion layer and a red-sensitive silver halide emulsion layer, respectively, in the case of A>B with respect to the developing inhibiting power for the green-sensitive silver halide emulsion layer and A<B with respect to the developing inhibiting power for the red-sensitive silver halide emulsion layer, by addition of a DIR compound having the developing inhibitor B in the green-sensitive silver halide emulsion layer and a DIR compound having the developing inhibitor A in the red-sensitive silver halide emulsion layer, it becomes possible to make the self-layer inhibitions in respective layers weaker, while giving greater influences [greater I.I.E] to other color-sensitive layers to enable epoch-making improvement of I.I.E in both directions.

The manner of use of such a DIR compound, namely the method or criterion for determining the color-sensitive layer in which the DIR compound is to be added is not only effective in the above example, namely between the green-sensitive silver halide emulsion layer and the red-sensitive silver halide emulsion layer, but also between color-sensitive layers of different kinds. For example, when a developing inhibitor C and a developing inhibitor D are used in equal moles in a blue-sensitive silver halide emulsion layer and a green-sensitive silver halide emulsion layer, respectively, in the case of C>D with respect to the developing inhibiting power for the blue-sensitive silver halide emulsion layer and C<D with respect to the developing inhibiting power for the green-sensitive silver halide emulsion layer, by addition of a DIR compound having the developing inhibitor D in the blue-sensitive silver halide emulsion layer and a DIR compound having the developing inhibitor C in the green-sensitive silver halide emulsion layer, it becomes possible to make the self-layer inhibitions in respective layers weaker, while giving greater influences [greater I.I.E] to other color-sensitive layers to enable epoch-making improvement of I.I.E in both directions.

Also, for example, when a developing inhibitor E and a developing inhibitor F are used in equal moles in a blue-sensitive silver halide emulsion layer and a red-sensitive silver halide emulsion layer, respectively, in the case of E<F with respect to the developing inhibiting power for the blue-sensitive silver halide emulsion layer and E>F with respect to the developing inhibiting power for the red-sensitive silver halide emulsion layer, by addition of a DIR compound having the developing inhibitor E in the blue-sensitive silver halide emulsion layer and a DIR compound having the developing inhibitor F in the red-sensitive silver halide emulsion layer, it becomes possible to make the self-layer inhibitions in respective layers weaker, while giving greater influences [greater I.I.E] to other color-sensitive layers to enable epoch-making improvement of I.I.E in both directions.

The present invention is not limited to the case of employing the developing inhibitors in equal moles, but it is possible to increase I.I.E. both directions when the above relationship can be exhibited by increasing or decreasing the amounts of the respective developing inhibitors. For example, by use of a developing inhibitor G and a developing inhibitor H, in the case of G>>H with respect to developing inhibiting power for a green-sensitive silver halide emulsion layer and G>H with respect to developing inhibiting power for a red-sensitive silver halide emulsion layer in respective equal moles, when reduction in amount of the developing inhibitor G added (hereinafter expressed as the developing inhibitor G') makes the relationships of G'>H in the green-sensitive silver halide emulsion layer and G''<H in the red-sensitive silver halide emulsion layer valid, by addition of a DIR compound having the developing inhibitor H in the green-sensitive silver halide emulsion layer and a DIR compound having the developing inhibitor G in the red-sensitive silver halide emulsion layer at a lower (molar) level than in the former, great I.I.E. in both directions could be obtained. The same results were obtained between the color-sensitive layers of other different kinds.

And, when the combinations of the DIR compounds having respective inhibiting groups and the layers in which they are added are reversed (for example, in the above example, a DIR compound having the developing inhibitor A is added in the green-sensitive silver halide emulsion layer and a DIR compound having the developing inhibitor B in the red-sensitive silver halide emulsion layer), the self-layer inhibiting became very strong to make I.I.E. in both directions markedly small. These matters are clarified also in the Examples shown hereinafter.

In the present invention, the manner of use of the DIR compound, namely selection of the inhibiting group of said DIR compound may be done, for example, according to the method as described below.

On a transparent support, three kinds of light-sensitive materials having the layers with the following compositions are prepared.

Sample (I): A sample having a red-sensitive silver halide emulsion layer

A gelatin coating solution containing a silver iodobromide (silver iodide: 6 mole %, average grain size: 0.48 μm) spectrally sensitized to red-sensitive with a sensitizing dye and 0.08 mole of the exemplary coupler (C - 7) per mole of silver is applied to a coated silver amount of 1.4 g/m$^2$.

Sample (II): A sample having a green-sensitive silver halide emulsion layer

A gelatin coating solution containing a silver iodobromide (silver iodide: 6 mole %, average grain size: 0.48 μm) spectrally sensitized to green-sensitive with a sensitizing dye and 0.07 mole of the exemplary coupler (M - 2) per mole of silver is applied to a coated silver amount of 1.1 g/m$^2$.

Sample (III): A sample having a blue-sensitive silver halide emulsion layer

A gelatin coating solution containing a silver iodobromide (silver iodide: 6 mole %, average grain size: 0.48 μm) spectrally sensitized to blue-sensitive with a sensitizing dye and 0.34 mole of the exemplary coupler (Y - 4) per mole of silver is applied to a coated silver amount of 0.5 g/m$^2$.

In the respective layers, there are contained gelatin hardeners and surfactants in addition to the above components. Incidentally, these samples are prepared in accordance with the light-sensitive materials prepared in Examples mentioned hereinafter.

The obtained samples (I) to (III) are subjected to white light exposure by use of a wedge and processed in the same manner as the processing method in Example 1 shown below except for making the developing time 1 min. 45 sec. for (I), 2 min. 40 sec. for (II) and 3 min. 15 sec. for (III). The developing time is a time for being closely resembled the developability of each color-sensitive layer of a multi-layered sample in a single-layered sample. That is, the above developing time is so selected the developability of the above single layered samples as to closely resemble to respective layers in the multi-layered constitution. In the developing solutions employed, various kinds of developing inhibitors in various amounts are added so that the developing inhibiting power in the sample (II) may be equal, or no inhibitor is added. The difference (ΔS) between the sensitivity *1 ($S_0$) of the respective samples (I) to (III) processed with the developer containing no developing inhibitor and the sensitivity *2 (S) of the respective samples obtained by development of a developing solution containing the developing inhibitors is used as a measure of the developing inhibiting power in the respective color-sensitive layers by the respective developing inhibitors.

*1) The logarithmic value of the reciprocal of the exposure dose ($E_0$) at the density point with fog density+0.3, namely $-\log E_0$ is defined as sensitivity $S_0$.

*2) Similarly as the above *1), the logarithmic value of the reciprocal of the exposure dose (E) at the density point with fog density+0.3, namely $-\log E$ is defined as sensitivity S.

The differences in developing inhibiting power of several kinds of developing inhibitors for respective color-sensitive layers conducted on the basis of the above standard experiments are shown in Table 1.

TABLE 1

| Compound No. | Structure | Amount added (mole/l) | Inhibiting power ΔS (Δlog E) Sample (I) | Sample (II) | Sample (III) |
|---|---|---|---|---|---|
| A-1 | 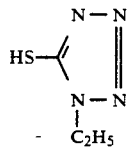 | $1.5 \times 10^{-4}$ | 0.43 | 0.53 | 0.34 |
| A-2 | 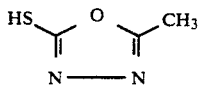 | $1.5 \times 10^{-4}$ | 0.48 | 0.53 | 0.24 |
| A-3 | 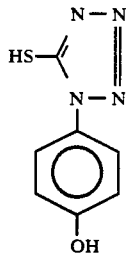 | $1.0 \times 10^{-4}$ | 0.72 | 0.51 | 0.48 |
| A-4 | 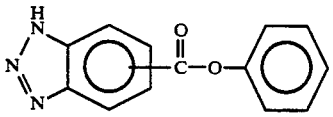 | $1.0 \times 10^{-4}$ | 0.64 | 0.50 | 0.38 |
| A-5 | 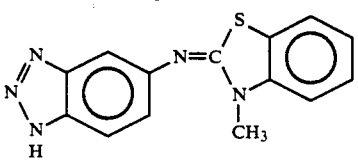 | $0.2 \times 10^{-4}$ | 0.60 | 0.49 | 0.45 |

TABLE 1-continued

| Compound No. | Structure | Amount added (mole/l) | Inhibiting power ΔS (Δlog E) Sample (I) | Sample (II) | Sample (III) |
|---|---|---|---|---|---|
| A-6 | 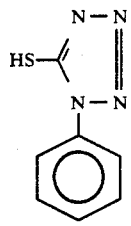 | $0.2 \times 10^{-4}$ | 0.58 | 0.51 | 0.45 |

When employing the DIR couplers having the above developing inhibitors A - 1 to A - 6, they can be used in a combination such that developing inhibition is small in the layer itself added and developing inhibition is great in another layer.

Since it is confirmed by the another experiment that order of developing inhibiting powers of each developing inhibitor as exemplified in Table 1 to the respective color-sensitive layers in this system is not changed by the amount added, for making a preferable combination between a red-sensitive silver halide emulsion layer and a blue-sensitive silver halide emulsion layer, it is easily understand, for example, the values in the red-sensitive silver halide emulsion layer (Sample (I)) are normalized to the values for one compound, and the values of the blue-sensitive silver halide emulsion layer (Sample (III)) divided by the ratio obtained by normalization is determined (see Table 2).

TABLE 2

| | Sample (I) | | Sample (III) | |
|---|---|---|---|---|
| | | Normalization | | Inhibiting power ratio |
| A-1 | 0.43 | 0.43 | 0.34 | 0.34 |
| A-2 | 0.48 | 0.43 | 0.24 | 0.22 |
| A-3 | 0.72 | 0.43 | 0.48 | 0.29 |
| A-4 | 0.64 | 0.43 | 0.38 | 0.26 |

That is, from Table 2, the following examples of combinations are included.

Examples of combinations of the developing inhibitor of DIR compound added in red-sensitive silver halide emulsion layer/the developing inhibitor of DIR compound added in green-sensitive silver halide emulsion layer (1) A-1/A-2, (2) A-1/A-3, (3) A-1/A-4, (4) A-1/A-5, (5) A-1/A-6, (6) A-2/A-3, (7) A-2/A-4, (8) A-2/A-5, (9) A-2/A-6, (10) A-4/A-3, (11) A-5/A-3, (12) A-5/A-4, (13) A-6/A-3, (14) A-6/A-4, etc.

Similarly, also between the green-sensitive silver halide emulsion layer and the blue-sensitive silver halide emulsion layer, between the red-sensitive silver halide emulsion layer and the blue-sensitive silver halide emulsion layer, preferable combinations with smaller inhibition in the added layer and greater inhibition in another layer can be selected. In the present invention, for selecting the inhibiting agent, it is preferred to employ the above described manner, that is, the sample and the method.

Also, for emphasizing I.I.E., the action distance of the inhibiting groups should preferably be great. That is, the so-called diffusiveness should be preferably great.

In the present invention, the diffusiveness of the inhibiting group can be evaluated according to the method described below.

On a transparent support, light-sensitive samples (IV) and (V) comprising the layers with the following compositions are prepared.

Sample (IV): A sample having a green-sensitive silver halide emulsion layer

A gelatin coating solution containing a silver iodobromide (silver iodide: 6 mole %, average grain size: 0.48 μm) spectrally sensitized to green-sensitive and 0.07 mole of the exemplary coupler (M - 2) per mole of silver was applied to a coated silver amount of 1.1 g/m$^2$ and a gelatin attached amount of 3.0 g/m$^2$, followed by coating thereon of a protective layer: a gelatin coating solution containing silver iodobromide (silver iodide: 2 mole %, average grain size: 0.08 μm) not applied with chemical sensitization and spectral sensitization to a coated silver amount of 0.1 g/m$^2$ and a gelatin attached amount of 0.8 g/m$^2$.

Sample (V): The protective layer in the above sample (IV) from which silver iodobromide is removed.

In the respective layers, there are contained gelatin hardeners and surfactants in addition to the above components.

The samples (IV) and (V) are subjected to white light exposure and then processed according to the processing method as Example 1 except for changing the developing time to 2 min. 40 sec. In the developing solutions employed, various developing inhibitors are added in an amount of inhibiting the sensitivity of the sample (V) to 60% (in terms of logarithmic representation, $-\Delta\log E=0.22$), or no developing inhibitor is added at all.

When no developing inhibitor is added, the sensitivity of the sample (IV) is defined as $S_0$ and the sensitivity of the sample (V) as $S_0'$, while when developing inhibitor is added, the sensitivity of the sample (IV) is defined as $S_{IV}$ and the sensitivity of the sample (V) as $S_V$.

Sensitivity reduction of sample (IV):

$$\Delta S_0 = S_0' - S_{IV}.$$

Sensitivity reduction of sample (V):

$$\Delta S = S_0 - S_V.$$

Diffusiveness $= \Delta S/\Delta S_0$.

Sensitivities are all logarithmic values of the reciprocal of exposure dose ($-\log E$) at the density point with fog density $+0.3$.

The value determined by this method is made a measure of diffusiveness. Diffusivenesses of several kinds of developing inhibitors are shown in Table 3.

TABLE 3
| Compound No. | Structure | Amount added (mole/l) | Sensitivity reduction $\Delta S_0$ | Sensitivity reduction $\Delta S$ | Diffusiveness $\Delta S/\Delta S_0$ |
|---|---|---|---|---|---|
| A-6 | 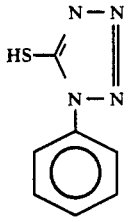 | $1.3 \times 10^{-5}$ | 0.22 | 0.05 | 0.23 |
| A-5 | 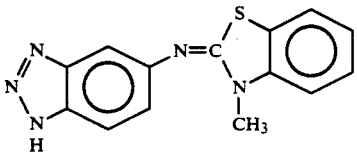 | $1.3 \times 10^{-5}$ | 0.23 | 0.08 | 0.34 |
| A-2 | 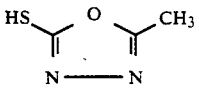 | $2.5 \times 10^{-5}$ | 0.22 | 0.10 | 0.45 |
| A-1 | 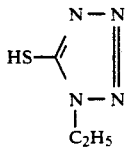 | $3.0 \times 10^{-5}$ | 0.21 | 0.10 | 0.48 |
| A-9 | 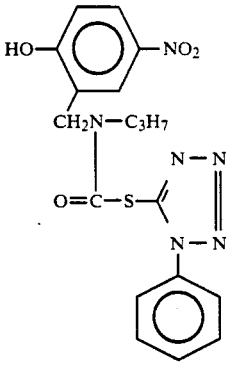 | $1.4 \times 10^{-5}$ | 0.23 | 0.11 | 0.48 |
| A-3 | 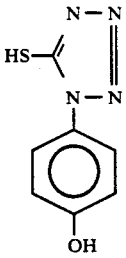 | $2.5 \times 10^{-5}$ | 0.22 | 0.13 | 0.59 |
| A-4 | 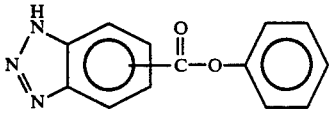 | $3.5 \times 10^{-5}$ | 0.23 | 0.15 | 0.65 |
| A-7 | 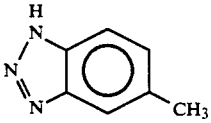 | $4.3 \times 10^{-5}$ | 0.22 | 0.16 | 0.73 |

TABLE 3-continued

| Compound No. | Structure | Amount added (mole/l) | Sensitivity reduction $\Delta S_0$ | Sensitivity reduction $\Delta S$ | Diffusiveness $\Delta S/\Delta S_0$ |
|---|---|---|---|---|---|
| A-8 | 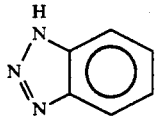 | $1.7 \times 10^{-4}$ | 0.21 | 0.20 | 0.95 |

As is also apparent from Example 1 shown below, a compound with relatively smaller diffusiveness (A - 5: 0.34 or less) is also small in I.I.E., and therefore a compound with a diffusiveness exceeding 0.34 is preferred. In the present invention, compounds with diffusiveness of 0.4 or higher are further preferred.

In the light-sensitive silver halide color photographic material of the present invention, the respective emulsion layers with the same sensitivity (or at least one layer) can be divided into three layers or more, but it is preferred that the number of the layers should not exceed 3 layers for diffusiveness of the inhibitor or the inhibitor precursor formed from the DIR compound of the present invention.

In recent years, light-sensitive silver halide color photographic materials having sensitivity and good color reproducibility have been desired. The present invention is effectively applicable or even more effective for such a highly sensitive light-sensitive silver halide color photographic material.

As the layer constitution for higher sensitization, the following constitutions have been known. For example, in the above normal order layer constitution having respective silver halide emulsion layers of a red-sensitive silver halide emulsion layer, a green-sensitive silver halide emulsion layer and a blue-sensitive silver halide emulsion layer successively provided by coating on a support, there is a layer constitution in which, for a part or all of the light-sensitive silver halide emulsion layers, substantially the same color-sensitive layers are separated into a high sensitivity silver halide emulsion layer (hereinafter called high sensitivity emulsion layer) and a low sensitivity silver halide emulsion layer (hereinafter called low sensitivity emulsion layer) containing diffusion-resistant couplers color formed mutually to substantially the same hue, which are overlaid adjacent to each other. This layer constitution is hereinafter referred to as the high sensitivity normal order layer constitution.

On the other hand, as the reverse layer constitution accomplishing high sensitivity, the following techniques have been known.

[A] First, Japanese Provisional Patent Publication No. 49027/1976 discloses a constitution comprising:

(a) the respective low sensitivity emulsion layers of a red sensitive silver halide emulsion layer and a green-sensitive silver halide emulsion layer (RG low sensitivity layer unit) provided by coating on a support in this order from the support side;

(b) the respective high sensitivity emulsion layers of a red-sensitive silver halide emulsion layer and a green-sensitive silver halide emulsion layer (RG high sensitivity layer unit) on said RG low sensitivity layer unit from the support side; and (c) high sensitivity and low sensitivity emulsion layers of a blue-sensitive silver halide emulsion layer (B high and low sensitivity layer unit) provided by coating on said RG high sensitivity layer unit as in the normal order layer constitution.

[B] Also, Japanese Provisional Patent Publication No. 97424/1978 discloses a constitution of the light-sensitive silver halilde color photographic material with the above constitution [A], in which the red-sensitive silver halide emulsion layer and the green-sensitive silver halide emulsion layer in the RG low sensitivity layer unit are provided by coating as separated into medium sensitivity and low sensitivity layers.

[C] Further, Japanese Provisional Patent Publication No. 177551/1984 by the present Applicant discloses a constitution in which the RGB low sensitivity layer unit and the RGB high sensitivity layer unit are provided successively by coating on a support.

These light-sensitive silver halide color photographic materials with the constitutions [A], [B] and [C] (hereinafter referred to as high sensitivity reverse layer constitution) all have at least a high sensitivity red-sensitive silver halide emulsion layer with between a high sensitivity green-sensitive silver halide emulsion layer and a green-sensitive silver halide emulsion layer with lower sensitivity than said high sensitivity green-sensitive silver halide emulsion layer, and they are effective means for accomplishing the object of high sensitivity and high image quality.

The present invention is effectively applicable, or even more effective for any of the light-sensitive silver halide color photographic materials with the high sensitivity normal order layer constitution or the high sensitivity reverse order constitution as described above.

As described above, for application of the present invention for the case of a plural number of the same color-sensitive layers, the DIR compound to be combined in the present invention may be added into one of the layers, but it can more effectively be used in the plural number of layers of said same color-sensitive layer. When the same color-sensitive layer is plural in number, and the compound is added only in one layer, it should advantageously be added in the layer in which silver is most enriched. Further, as the silver halide grains, the aforesaid substantially monodispersed core/-shell type silver halide grains or twinned crystal silver halide grains are most preferred.

These silver halide emulsions in accordance with the present invention may be chemically sensitized with a single sensitizer or a suitable combination of sensitizers.

The silver halide emulsion according to the present invention may be prepared by carrying out chemical ripening with addition of a sulfur-containing compound and incorporating at least one of hydroxytetrazaindene and at least one of nitrogen-containing heterocyclic compounds having mercapto group before, during or after the chemical ripening.

The silver halides to be used in the present invention may also be optically sensitized with addition of $5\times10^{-8}$ to $3\times10^{-3}$ mole of a suitable sensitizing dye in order to impart photosensitivity to the respective desired photosensitive wavelength regions. As the sensitizing dye, various dyes can be used and a combination with one dye or two or more dyes can also be used.

For addition of sensitizing dyes into the silver halide emulsion according to the present invention, they can be used as the dye solutions by dissolving them previously in hydrophilic solvents such as methyl alcohol, ethyl alcohol, acetone and dimethylformamide, or fluorinated alcohols as disclosed in Japanese Patent Publication No. 40659/1975.

The timing of addition may be either at initiation of chemical ripening of the silver halide emulsion, during the chemical ripening or on completion of the chemical ripening. In some cases, they can be added also in the step immediately before coating of the emulsion.

In the light-sensitive silver halide color photographic material of the present invention, there may also be incorporated water-soluble dyes as filter dyes in hydrophilic colloid layers or for various other purposes such as irradiation prevention, etc. Such dyes may include oxonol dyes, hemioxonol dyes, merocyanine dyes and azo dyes. Among them, oxonol dyes, hemioxonol dyes and merocyanine dyes are useful.

These water-soluble dyes can be more effectively fixed as mordant.

Next, the diffusive DIR compounds to be preferably used in the present invention are to be described.

The diffusive DIR compounds of the present invention are represented by the formula shown below. Formula (A) of diffusive DIR compound:

A—Y)m wherein A represents a coupler component, m represents 1 or 2 and Y is a group which is bonded to the coupler component A at its coupling position and eliminable through the reaction with the oxidized product of a color developing agent, representing a developing inhibitor with great diffusiveness or a compound capable of releasing a developing inhibitor.

The group A may have the properties of a coupler and is not necessarily required to form a dye through coupling.

In the present invention, the diffusive compounds having the group Y in the above formula (1) represented by the following formulae (2A) to (2E) or (3) to (5) may preferably be employed. More preferred is the compound in which the eliminable group Y is represented by the formulae (2A), (2B), (2E) or (4), and particularly preferred is those represented by the formula (2B), (2E) or (4).

Formula (2A) of Y:

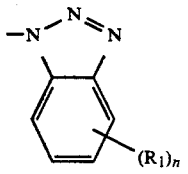

Formula (2B) of Y:

-continued

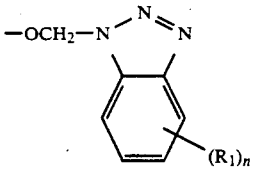

Formula (2C) of Y:

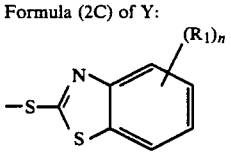

Formula (2D) of Y:

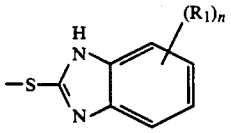

Formula (2E) of Y:

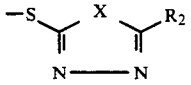

(X: O, S or Se)

Formula (3) of Y:

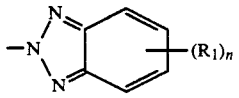

Formula (4) of Y:

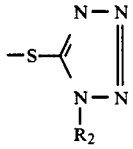

Formula (5) of Y:

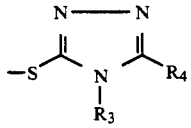

In the above formulae (2A) to (2D) and (3), $R_1$ represents an alkyl group, an alkoxy group, an acylamino group, a halogen atom, an alkoxycarbonyl group, a thiazolylideneamino group, an aryloxycarbonyl group, an acyloxy group, a carbamoyl group, an N-alkylcarbamoyl group, an N,N-dialkylcarbamoyl group, a nitro group, an amino group, an N-arylcarbamoyloxy group, a sulfamoyl group, an N-alkylcarbamoyloxy group, a hydroxy group, an alkoxycarbonylamino group, an alkylthio group, an arylthio group, an aryl group, a heterocyclic group, a cyano group, an alkylsulfonyl group or an aryloxycarbonylamino group. n represents 1 or 2 and, when n is 2, $R_1$ may be the same or different, and the total number of carbon atoms contained in $R_1$ in number of n may be 0 to 10.

$R_2$ in the above formula (2E) has the same meaning as $R_1$ in (2A) to (2D), X represents an oxygen atom or a sulfur atom and $R_2$ in the formula (4) represents an alkyl group, an aryl group or a heterocyclic group.

In the formula (5), $R_3$ represents a hydrogen atom, an alkyl group, an aryl group or a heterocyclic group; $R_4$ represents a hydrogen atoms, an alkyl group, an aryl group, a halogen atom, an acylamino group, an alkoxycarbonylamino group, an aryloxycarbonylamino group, an alkanesulfonamide group, a cyano group, a heterocyclic group, an alkylthio group or an amino group.

When $R_1$, $R_2$, $R_3$ or $R_4$ represents an alkyl group, it may be either substituted or unsubstituted, straight or branched, or it may also be a cyclic alkyl. The substituents may include a halogen atom, a nitro group, a cyano group, an aryl group, an alkoxy group, an aryloxy group, an alkoxycarbonyl group, an aryloxycarbonyl group, a sulfamoyl group, a carbamoyl group, a hydroxy group, an alkanesulfonyl group, an arylsulfonyl group, an alkylthio group or an arylthio group.

When $R_1$, $R_2$, $R_3$ or $R_4$ represents an aryl group, the aryl group may be substituted. The substituents may include an alkyl group, an alkenyl group, an alkoxy group, an alkoxycarbonyl group, a halogen atom, a nitro group, an amino group, a sulfamoyl group, a hydroxy group, a carbamoyl group, an aryloxycarbonylamino group, an alkoxycarbonylamino group, an acylamino group, a cyano group or a ureido group.

When $R_1$, $R_2$, $R_3$ or $R_4$ represents a heterocyclic group, it represents a 5- or 6-membered monocyclic or fused ring containing nitrogen atom, oxygen atom or sulfur atom as the hetero atom, selected from a pyridyl group, a quinolyl group, a furyl group, a benzothiazolyl group, an oxazolyl group, an imidazolyl group, a thiazolyl group, a triazolyl group, a benzotriazolyl group, an imide group, an oxazine group and the like, and these may be further substituted with substituents as enumerated above for the aryl group.

In the formulae (2E) and (4), $R_2$ may have 1 to 15 carbon atoms.

In the above formula (5), the total number of carbon atoms contained in $R_3$ and $R_4$ is 1 to 15.

In the above formula (1), Y represents the following formula (6) shown below.

Formula (6) of Y:

-TIME-INHIBIT wherein TIME group is a group which is bonded to the coupler at its coupling position, can be cleaved through the reaction with a color developing inhibition, and can release the INHIBIT group after cleavage from the coupler with moderate control; and INHIBIT group is a developing inhibitor.

In the formula (6), -TIME-INHBIT group can be shown by the following formulae (7) to (13):

Formula (7) of Y:

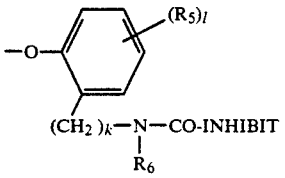

Formula (8) of Y:

-continued

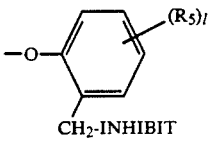

Formula (9) of Y:

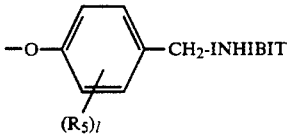

Formula (10) of Y:

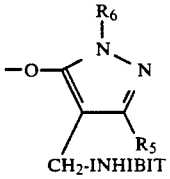

Formula (11) of Y:

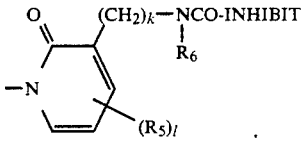

Formula (12) of Y:

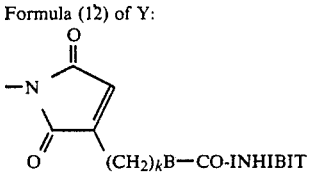

Formula (13) of Y:

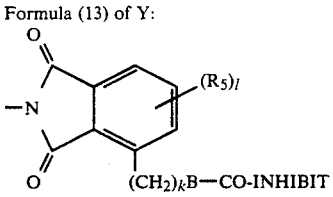

In the formulae (7) to (13), $R_5$ represents a hydrogen atom, a halogen atom, an alkyl group, an alkenyl group, an aralkyl group, an alkoxy group, an alkoxycarbonyl group, an anilino group, an acylamino group, a ureido group, a cyano group, a nitro group, a sulfonamide group, a sulfamoyl group, a carbamoyl group, an aryl group, a carboxy group, a sulfo group, a hydroxy group or an alkanesulfonyl group.

In the formulae (7), (8), (9), (11) and (13), l represents 1 or 2.

In the formulae (7), (11), (12) and (13), k represents an integer of from 0 to 2.

In the formulae (7), (10) and (11), $R_6$ represents an alkyl group, an alkenyl group, an aralkyl group, a cycloalkyl group or an aryl group.

In the formulae (12) and (13), B represents an oxygen atom or

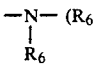

has the same meaning as defined above).

INHIBIT group represents the same meaning as defined for the formulae (2A), (2B), 3), (4) and (5) except for the carbon number.

However, in the formulae (2A), (2B) and (3), the total number of carbon atoms contained in each $R_1$ in one molecule is 1 to 32, while the number of carbon atoms contained in $R_2$ in the formula (4) is 1 to 32 and the total number of carbon atoms contained in $R_3$ and $R_4$ in the formula (5) is 0 to 32.

When $R_5$ and $R_6$ represent alkyl groups, they may be either substituted or unsubstituted, straight or cyclic. Substituents may include those as enumerated for the alkyl groups of $R_1$ to $R_4$.

When $R_5$ and $R_6$ represent aryl groups, the aryl group may be substituted. Substituents may include those as enumerated for the aryl groups of $R_1$ to $R_4$.

Of the diffusive DIR compounds as mentioned above, those having eliminable groups represented by the formula (2A), (2B), (2E) or (5) are particularly preferred.

As the yellow color image forming coupler residue represented by A in the formula (1), there may be included the coupler residues of pivaloylacetanilide type, benzoylacetanilide type, malondiester type, malondiamide type, dibenzoylmethane type, benzothiazolylacetamide type, malonestermonoamide type, benzothiazolyl acetate type, benzoxazolylacetamide type, benzoxazolyl acetate type, malondiester type, benzimidazolylacetamide type or benzimidazolyl acetate type; the coupler residues derived from heterocyclic substituted acetamide or heterocyclic substituted acetate included in U.S. Pat. No. 3,841,880; coupler residues derived from acylacetamides disclosed in U.S. Pat. No. 3,770,446, U.K. Patent No. 1,459,171, West German OLS No. 2,503,099, Japanese Provisional Patent Publication No. 139738/1975 or Research Disclosure No. 15737; or the heterocyclic coupler residue as disclosed in U.S. Pat. No. 4,046,574.

The magenta color image forming coupler residue represented by A may preferably be a coupler residue having a 5-oxo-2-pyrazoline nucleus, pyrazolone-[1,5-a]-benzimidazole nucleus or a cyanoacetophenone type coupler residue.

The cyano color image forming coupler residue represented by A may preferably be a coupler residue having a phenol nucleus, an o-naphthol nucleus, indazolone type or pyrazolotriazole type coupler residue.

Further, even if substantially no dye is formed after release of the developing inhibitor by coupling of the coupler with the oxidized product of a developing agent, the effect as the DIR coupler is the same. This type of coupler residue represented by A may include the coupler residues disclosed in U.S. Pat. Nos. 4,052,213, 4,088,491, 3,632,345, 3,958,993 or 3,961,959.

In the following, specific examples of the diffusive DIR compounds of the present invention are enumerated low, but these are not limitative of the present invention.

[Exemplary compounds]

D-1

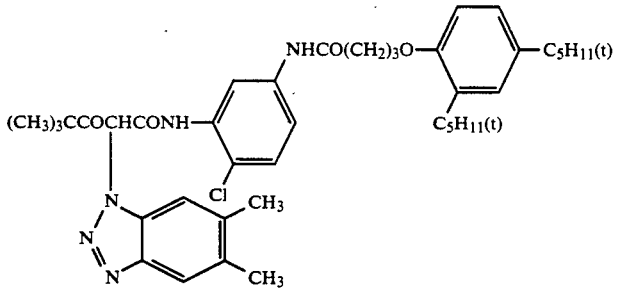

D-2

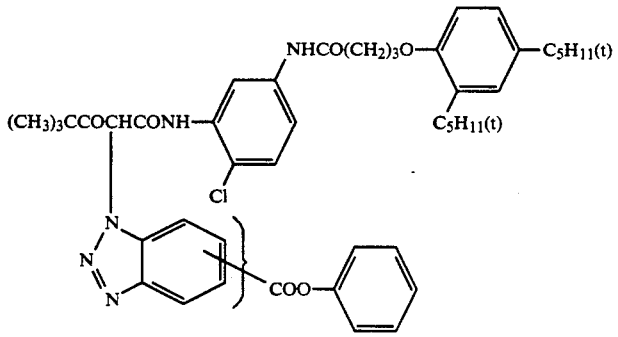

-continued
[Exemplary compounds]
D-3
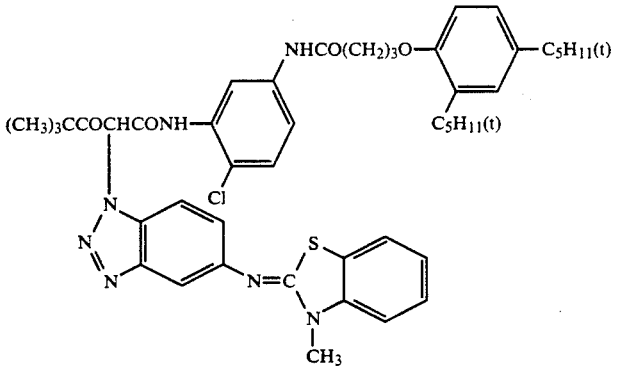
D-4
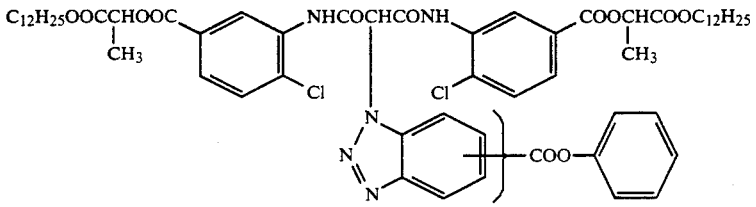
D-5
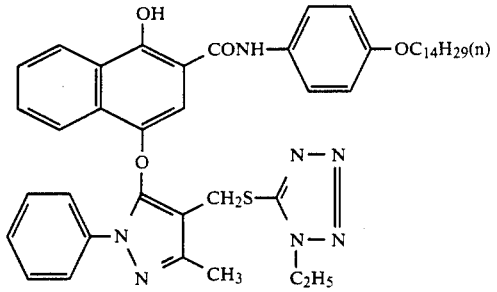
D-6
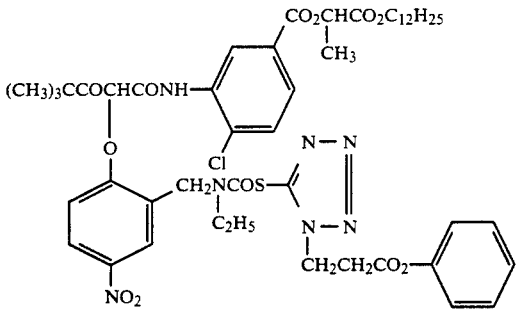
D-7
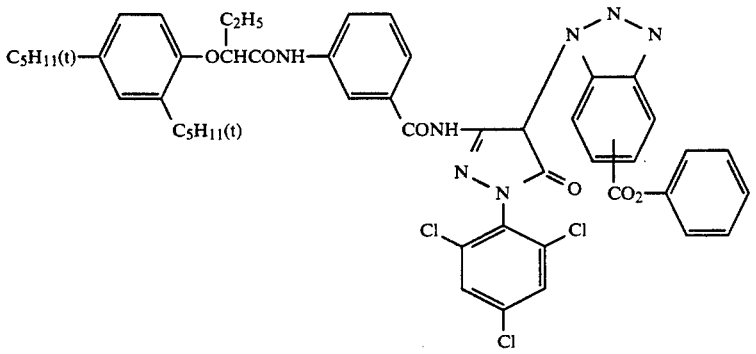

-continued
[Exemplary compounds]
D-8
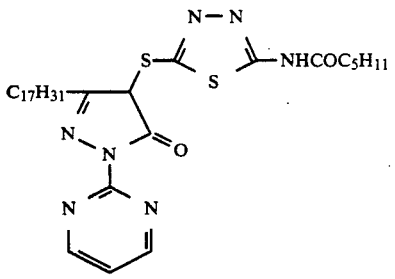
D-9
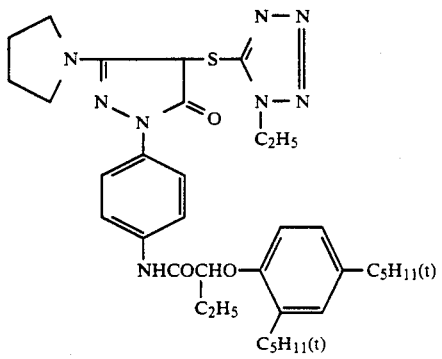
D-10
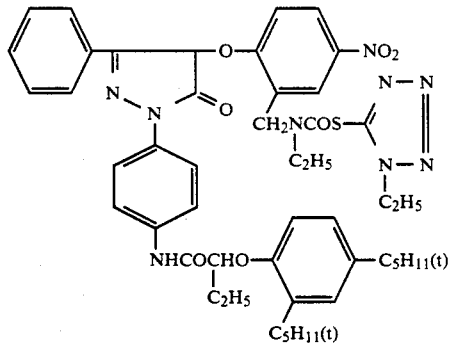
D-11
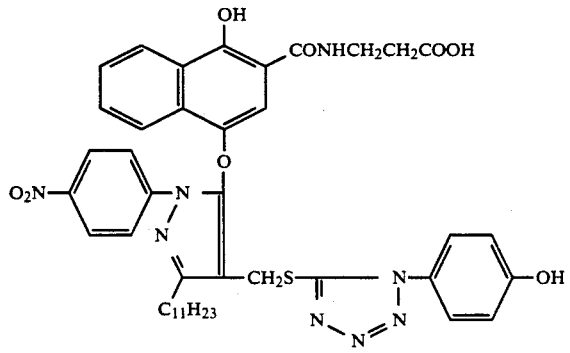

-continued
[Exemplary compounds]
D-12
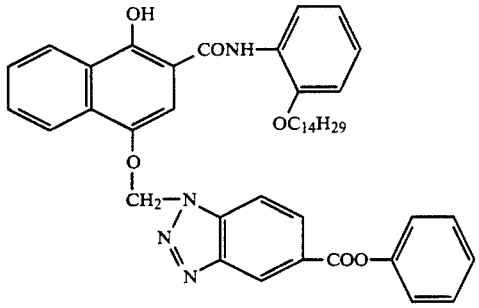
D-13
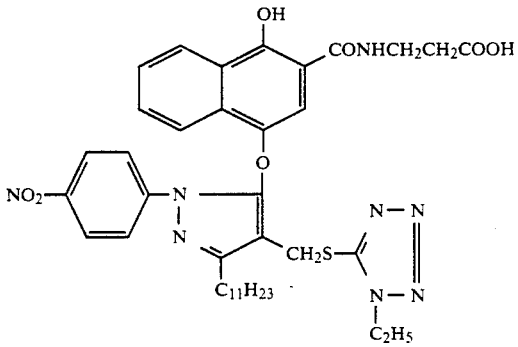
D-14
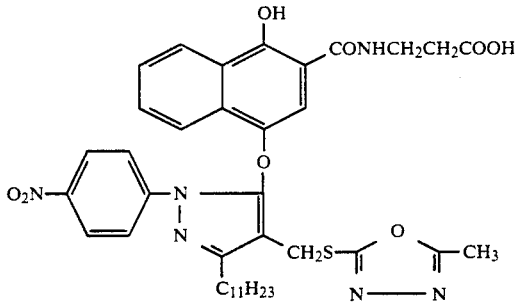
D-15
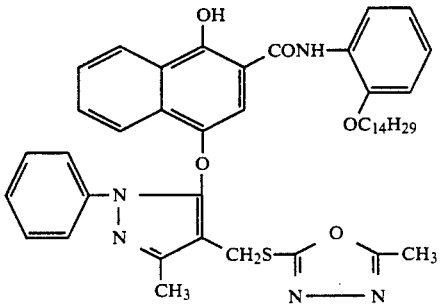

-continued
[Exemplary compounds]
D-16
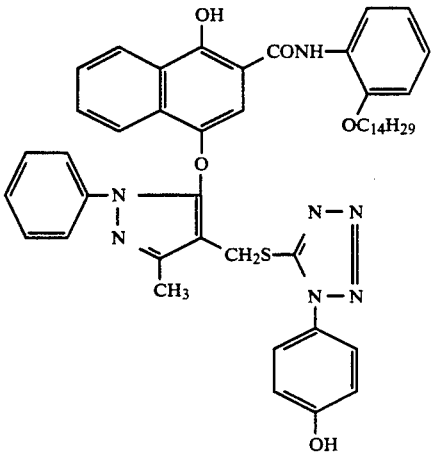
D-17
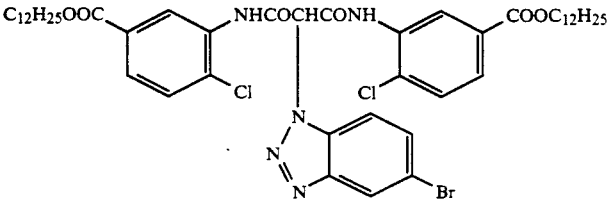
D-18
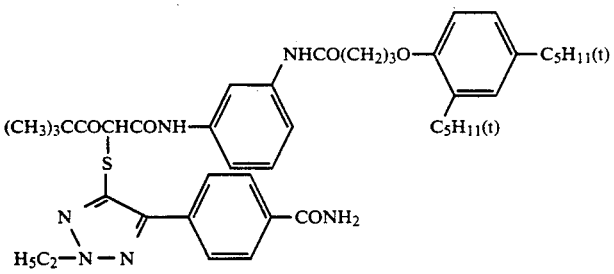
D-19
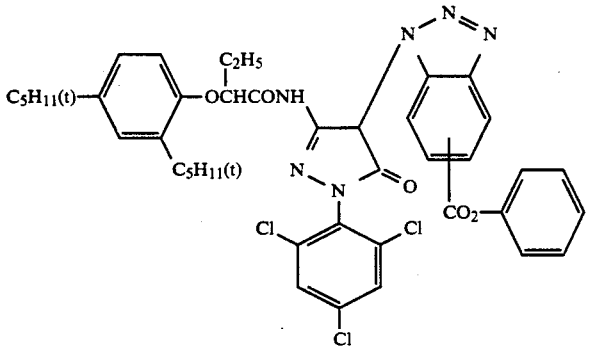

-continued
[Exemplary compounds]
D-20
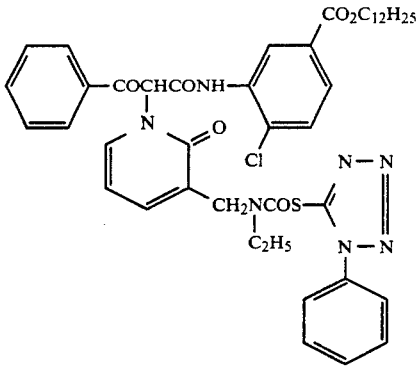
D-21
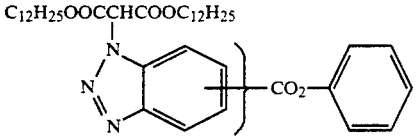
D-22
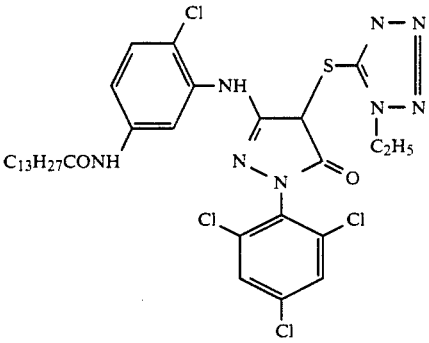
D-23
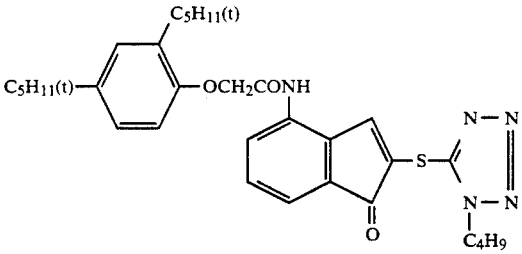
D-24
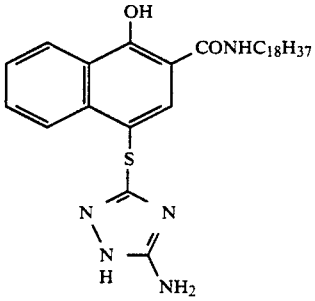

-continued
[Exemplary compounds]
D-25
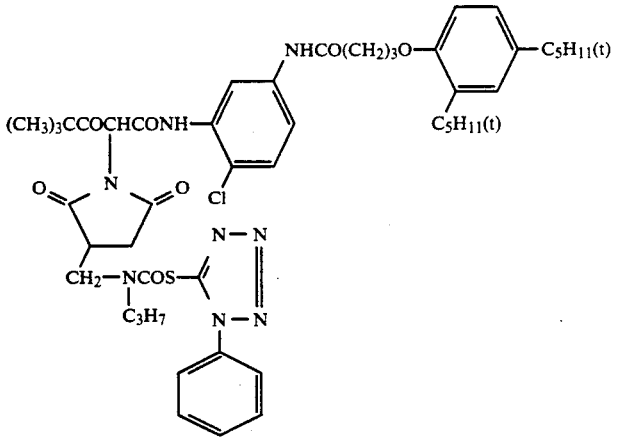
D-26
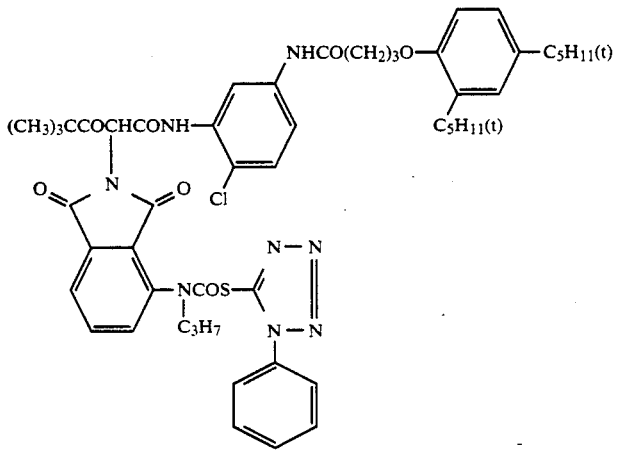
D-27
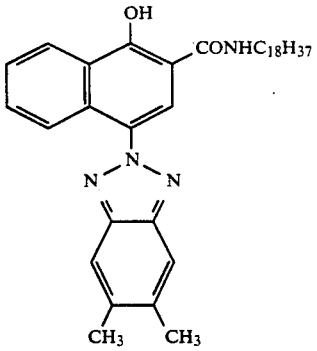
D-28
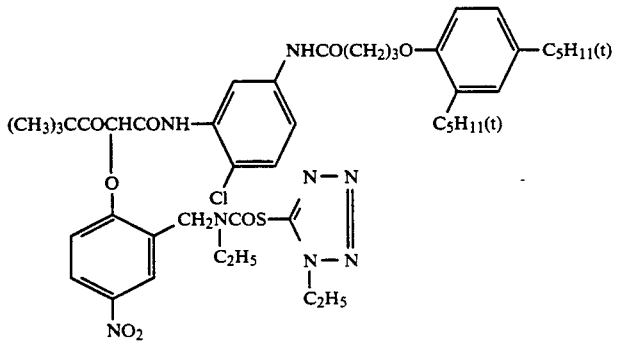

-continued
[Exemplary compounds]
D-29
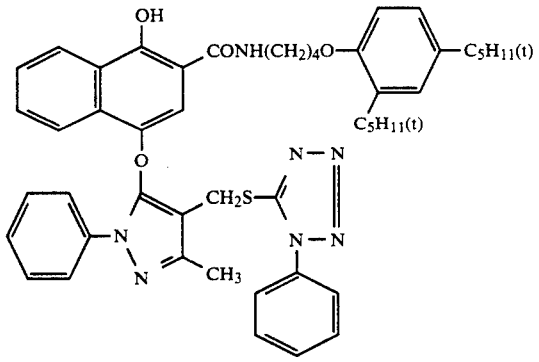
D-30
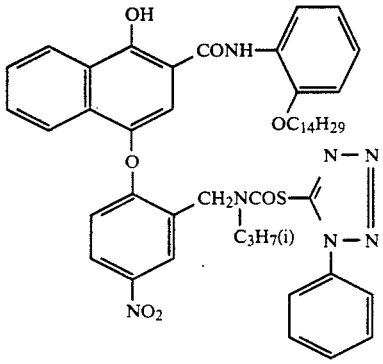
D-31
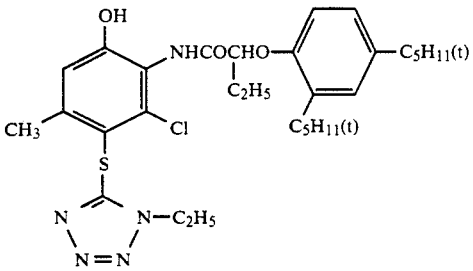
D-32
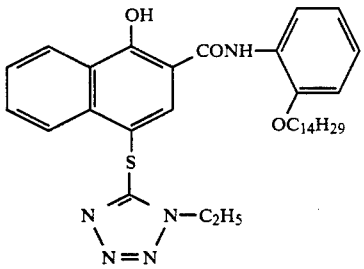
D-33
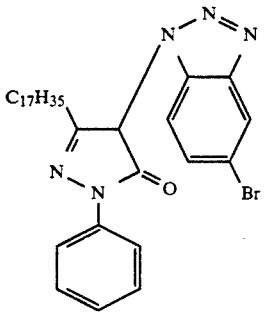

-continued
[Exemplary compounds]
D-34
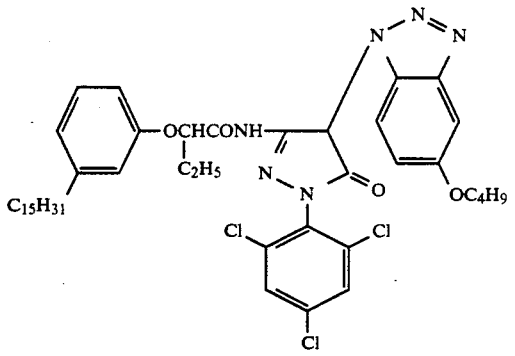
D-35
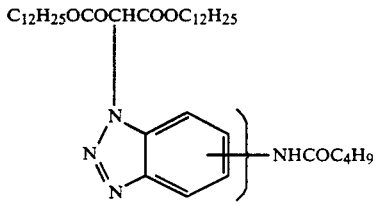
D-36
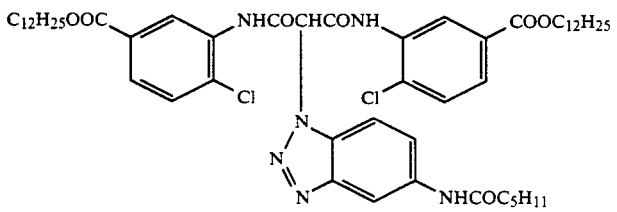
D-37
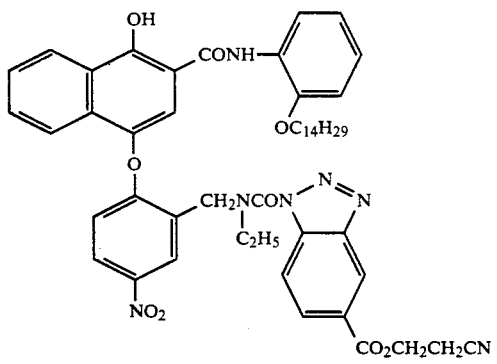
D-38
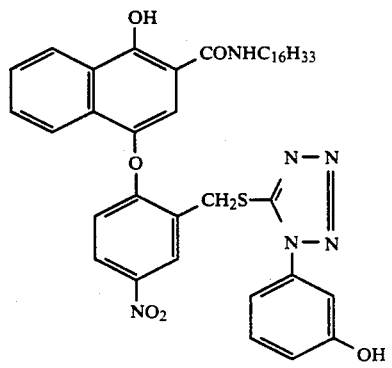

-continued
[Exemplary compounds]
D-39
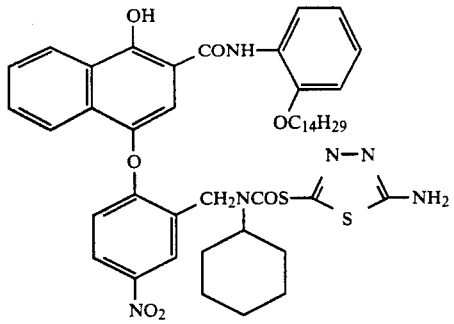
D-40
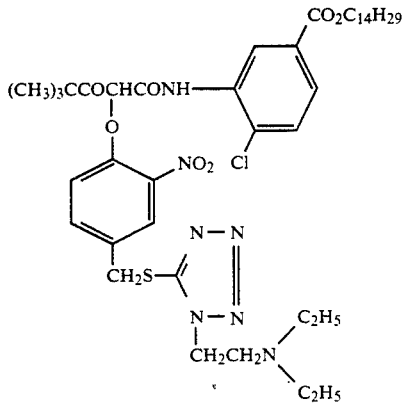
D-41
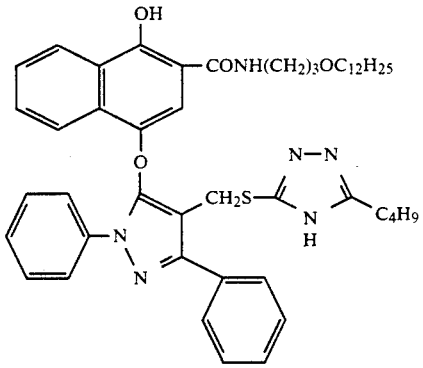
D-42
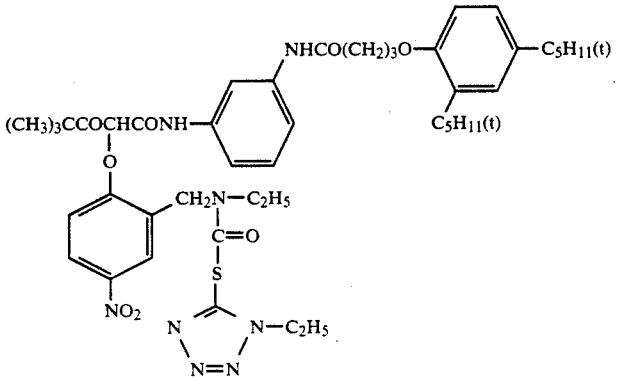

-continued
[Exemplary compounds]
D-43
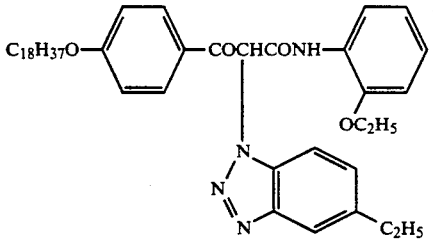
D-44
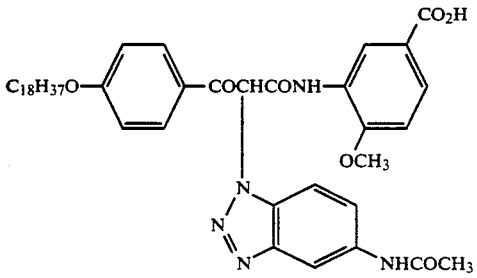
D-45
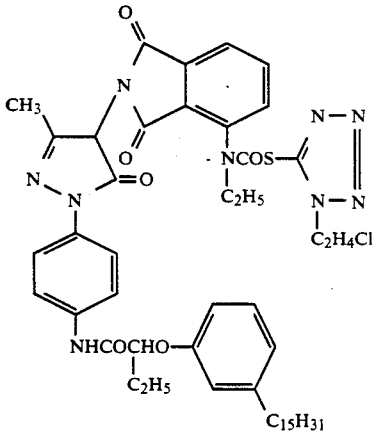
D-46
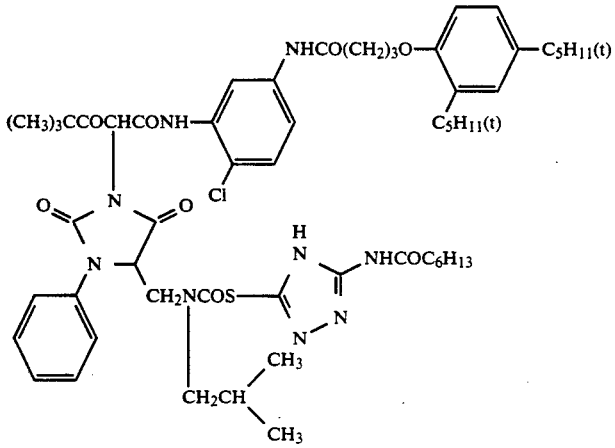

-continued
[Exemplary compounds]
D-47
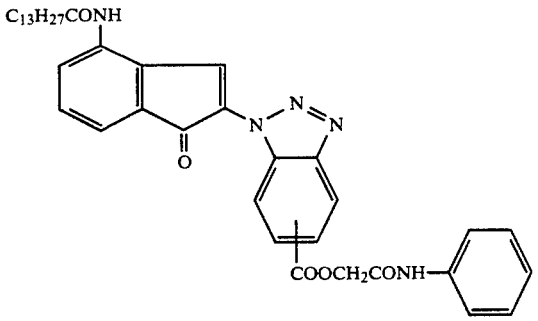
D-48
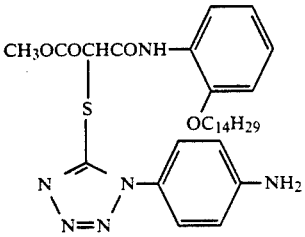
D-49
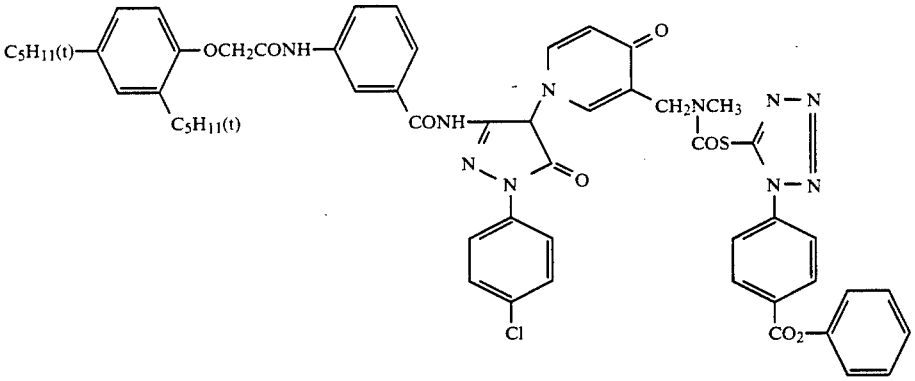
D-50
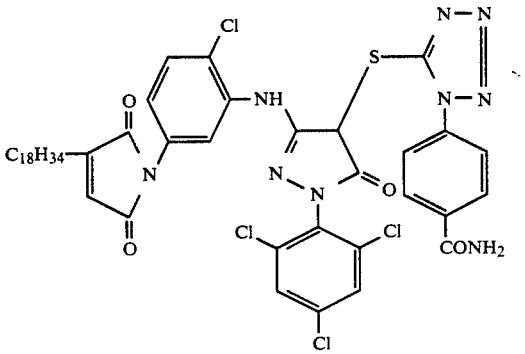

-continued
[Exemplary compounds]
D-51
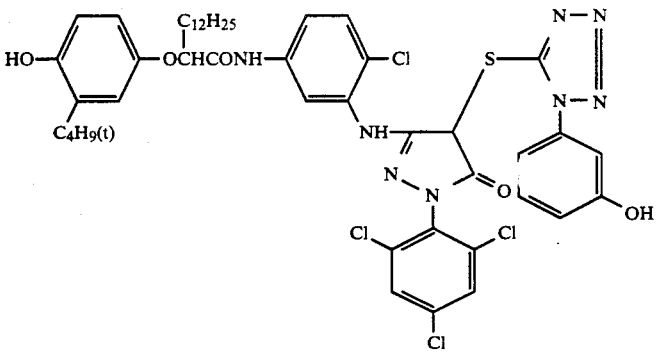
D-52
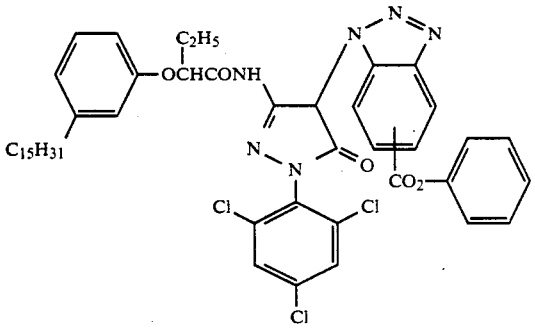
D-53
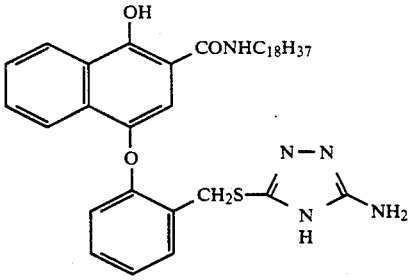
D-54
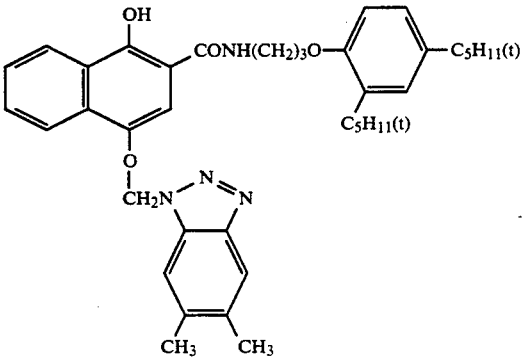

-continued
[Exemplary compounds]
D-55
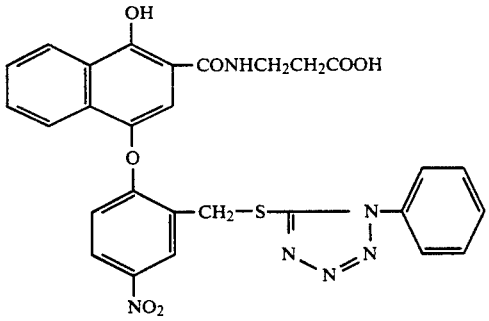
D-56
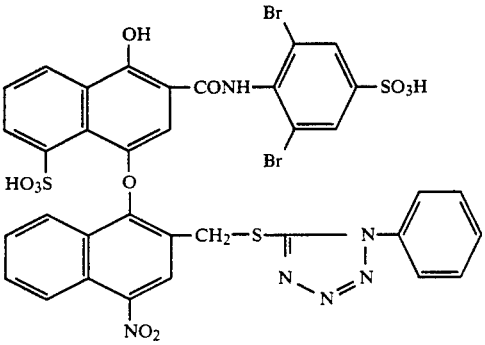
D-57
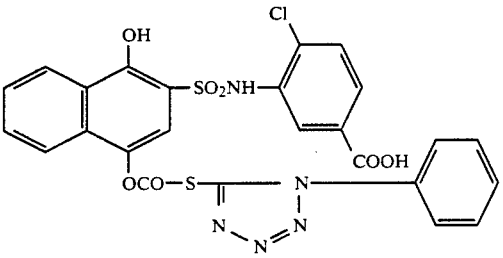
D-58
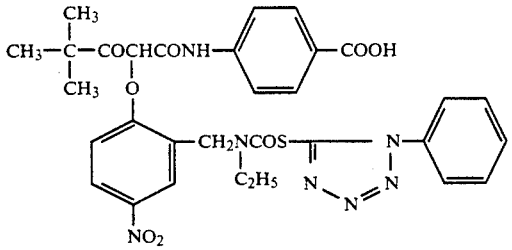
D-59
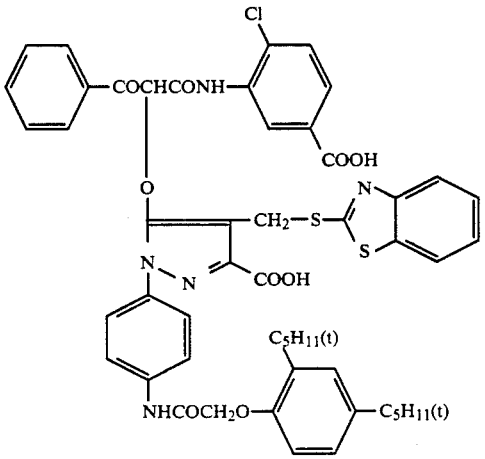

-continued
[Exemplary compounds]
D-60
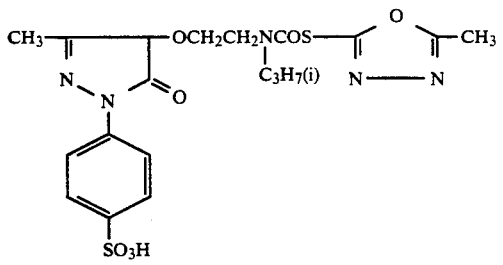
D-61
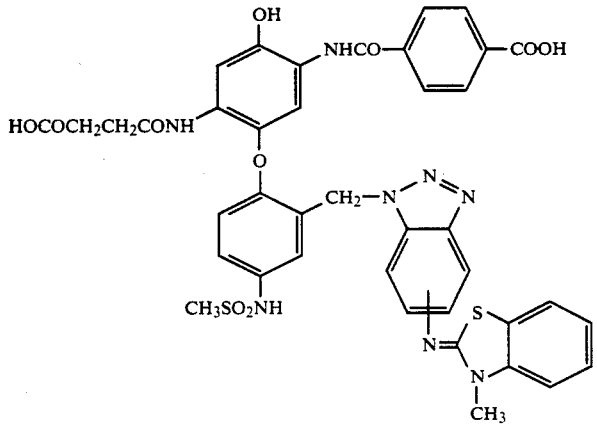
D-62
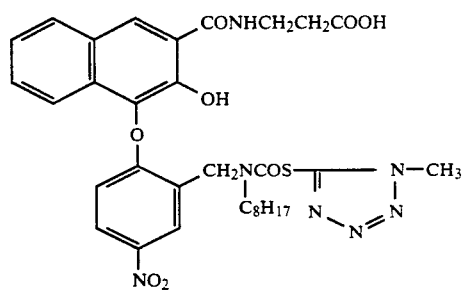
D-63
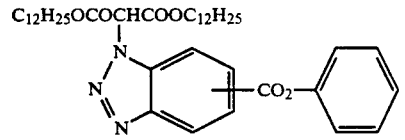
D-64
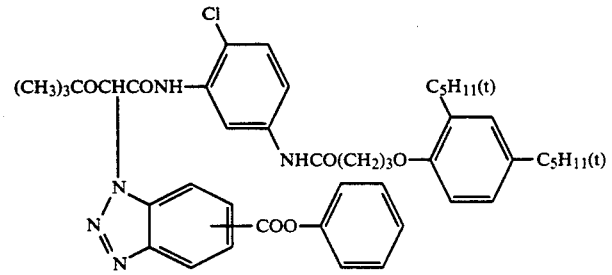

-continued
[Exemplary compounds]
D-65
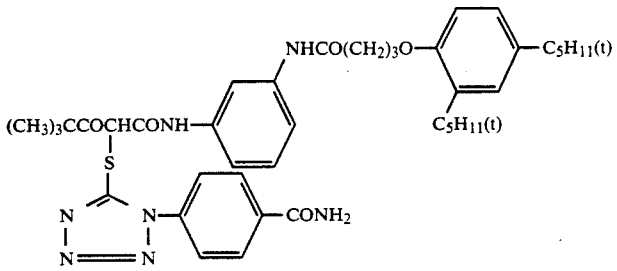
D-66
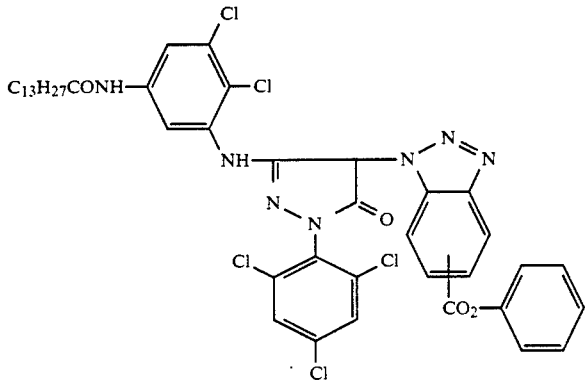
D-67
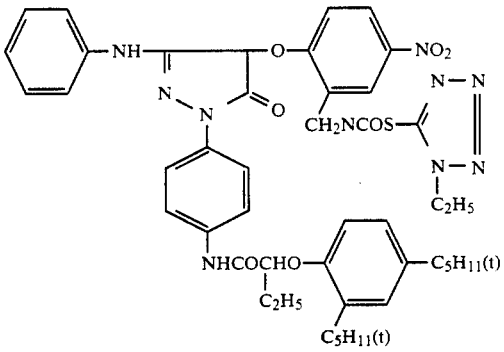
D-68
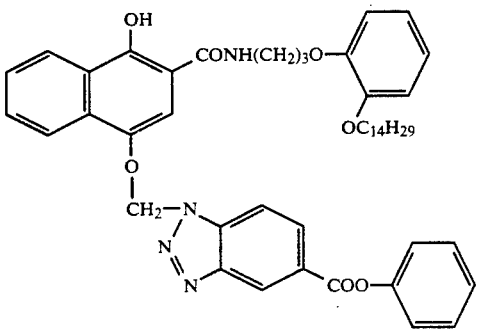

-continued
[Exemplary compounds]
D-69
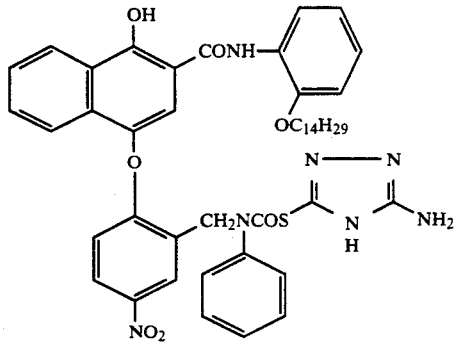
D-70
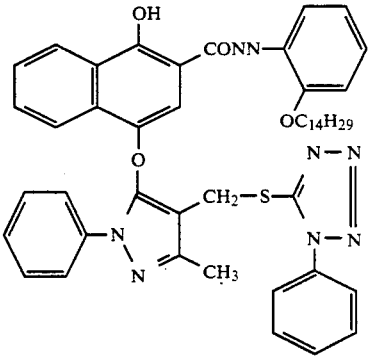
D-71
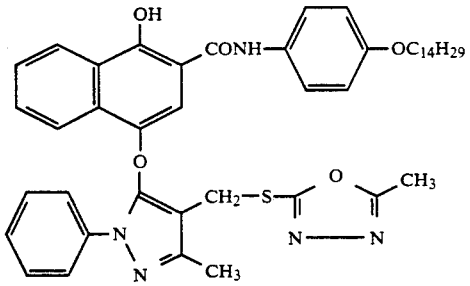
D-72
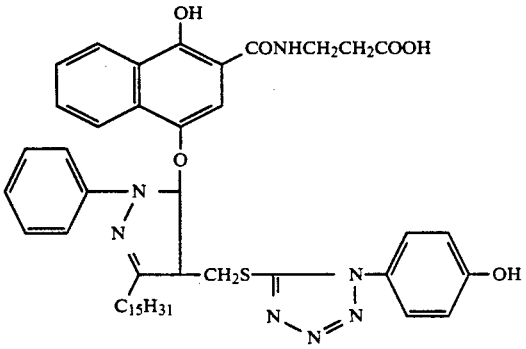

-continued

[Exemplary compounds]

D-73

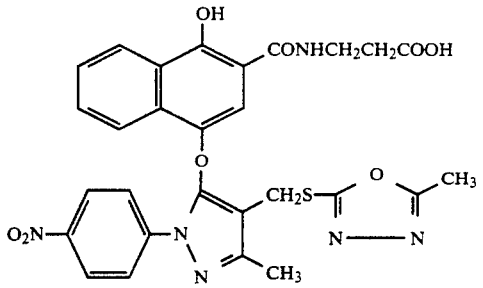

D-74

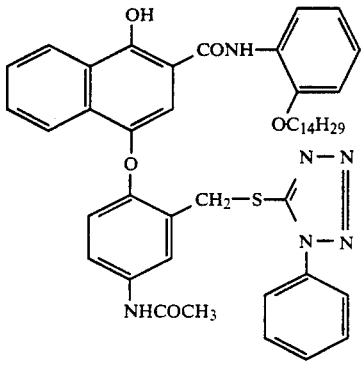

These compounds can be synthesized easily according to the methods as disclosed in U.S. Pat. Nos. 4,234,678, 3,227,554, 3,617,291, 3,958,993, 4,149,886 and No. 3,933,500; Japanese Provisional Patent Publication No. 56837/1982; Japanese Patent Publication No. 13239/1976; U.K. Patents No. 2,072,363 and No. 2,070,266; and Research Disclosure No. 21228, December, 1981.

Generally, an amount of the diffusive DIR compound of the present invention is preferably $2\times10^{-4}$ to $5\times10^{-1}$ mole, more preferably $5\times10^{-4}$ to $1\times10^{-1}$ mole per mole of silver in the emulsion layer.

In the present invention, the silver halide grains are monodispersed core/shell type silver halide grains having an iodide content in the core of 8 mole % or more to 30 mole % or less. Here, if the iodide content in the core is less than 8 mole %, while it will be mentioned hereinbelow, an expected development inhibiting effect could not be obtained since a released iodine ion from the core portion during development is little. On the other hand, if the iodine content of the core is in excess of 30 mole %, the development inhibiting effect is too large since the iodine ions are too much whereby coloring characteristics would be affected.

According to the synergistic effect of said silver halide grains and said DIR compound affecting with each other, color reproducibility and image quality of the color photographic material, particularly sharpness and graininess can remarkably be improved. This improvement of the image quality can be considered as follows: In the development inhibiting effect of the DIR compound and monodispersed core/shell type silver halide grains or twinned crystal silver halide grains affecting with each other, by being added uniformity of development which will be obtained from height of the monodispersibility and the development inhibiting effect of an iodine ion which is released from the core portion during development, it is estimated that remarkable improvement of sharpness would be occurred by the improvement of the graininess due to uniformity of a shape of a color dye cloud as well as inhibition of deterioration in the graininess due to diffusion of the oxidized product of the color developing agent and further by enhancement of the adjacent effect.

To describe in more detail about the light-sensitive material of the present invention, a conventional colored magenta coupler can be used in combination in the green-sensitive emulsion layer of the present invention. As the colored magenta coupler, those disclosed in U.S. Pat. Nos. 2,801,171 and 3,519,429 and Japanese Patent Publication No. 27930/1973 can be used.

Particularly preferable colored magenta couplers are shown below.

(CM-1)

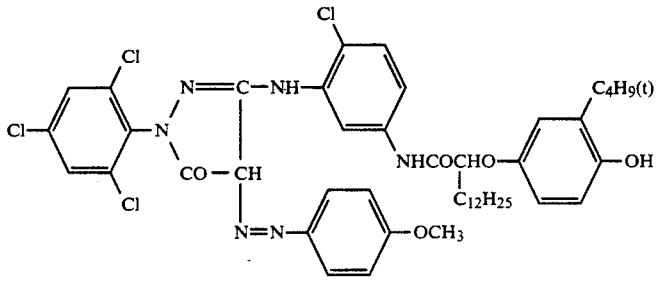

-continued
(CM-2)
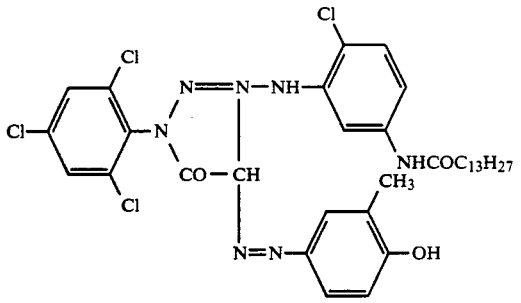
(CM-3)
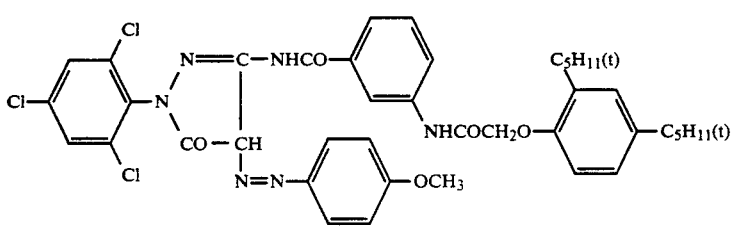
(CM-4)
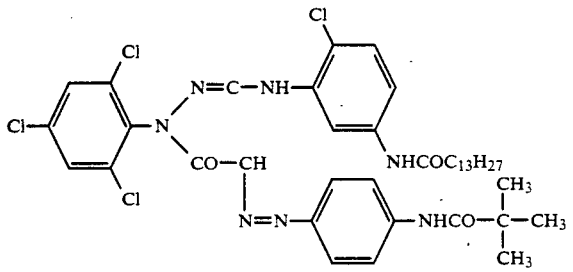
(CM-5)
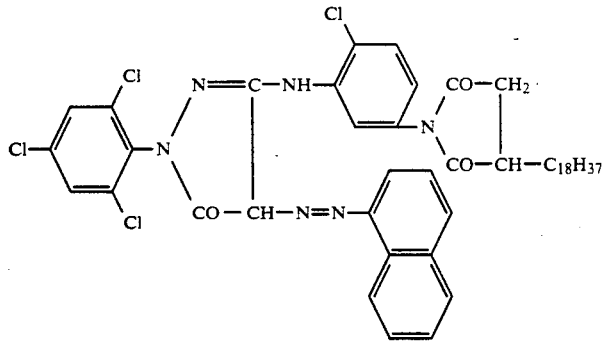
On the other hand, a conventional colored cyan coupler can be used in the red-sensitive emulsion layer of the present invention. As the colored cyan coupler, those disclosed in Japanese Patent Publication No. 32461/1980, U.K. Patent No. 1,084,480, etc. can be used.
Particularly preferable colored cyan couplers are shown below.
(CC-1)
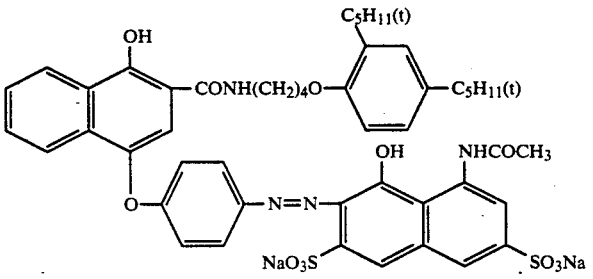

-continued (CC-2)

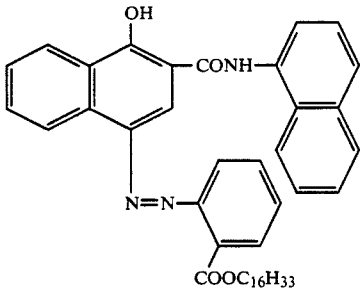

(CC-3)

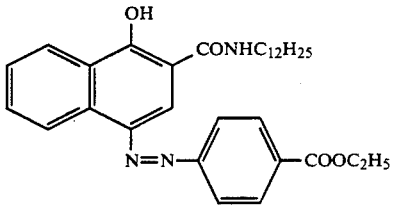

In the light-sensitive emulsion layer constituting the light-sensitive material of the present invention, the respective corresponding color forming couplers can be contained.

In the blue-sensitive layer of the present invention, it is generally preferable to contain a coupler for forming a yellow dye and, as said yellow color forming coupler, known open-chain ketomethylene type couplers can be employed. Among them, benzoylacetanilide type and pivaloylacetanilide type compounds can be advantageously used.

Examples of the yellow color forming couplers may include those disclosed in Japanese Provisional Patent Publications No. 26133/1972, No. 29432/1973, No. 87650/1975, No. 17438/1976 and No. 102636/1976; Japanese Patent Publication No. 19956/1970; U.S. Pat. Nos. 2,875,057, 3,408,194 and 3,519,429; Japanese Patent Publications No. 33410/1976, No. 10783/1976 and No. 19031/1971, etc.

Particularly preferable couplers are shown below.

(Y-1)

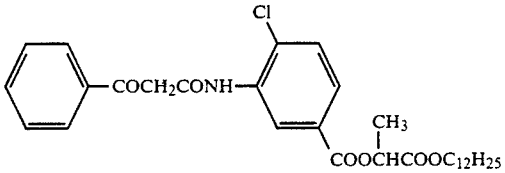

(Y-2)

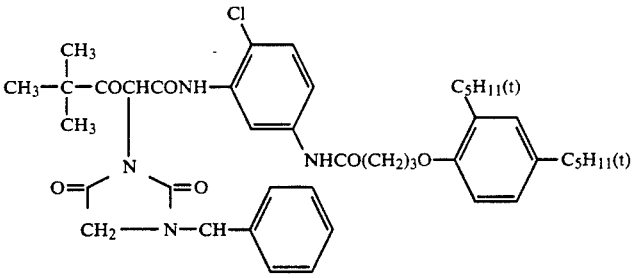

(Y-3)

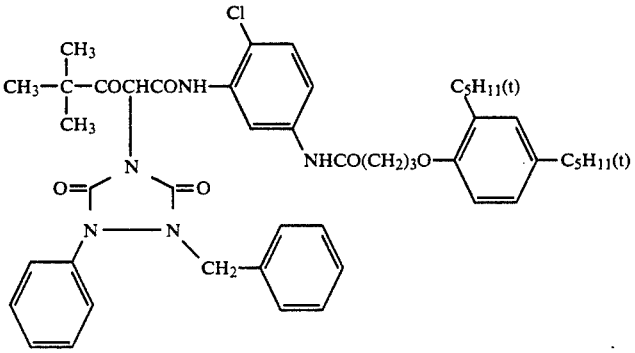

-continued
(Y-4)
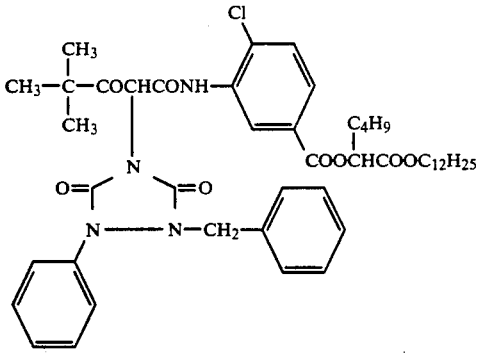
(Y-5)
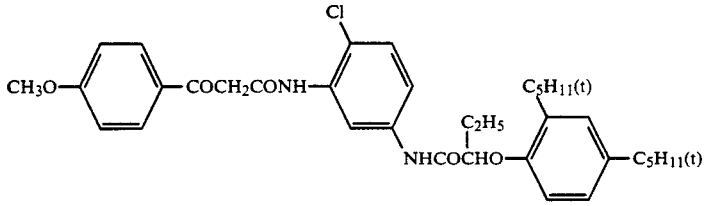
(Y-6)
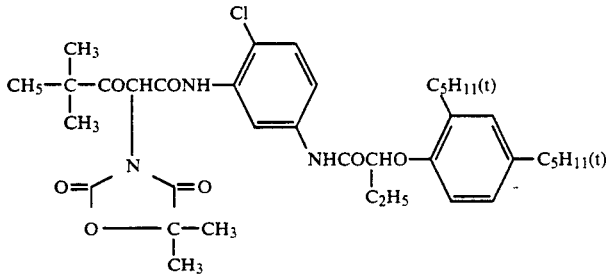
(Y-7)
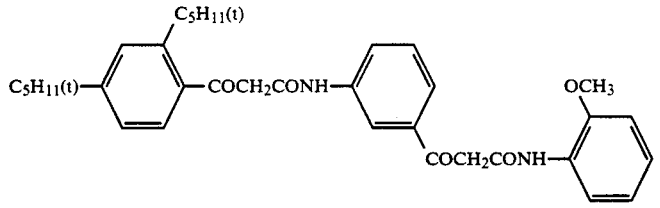
(Y-8)
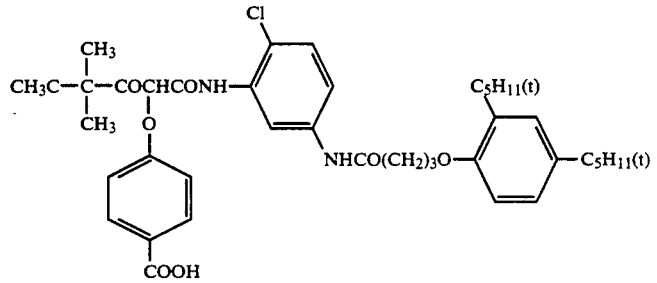

-continued
(Y-9)
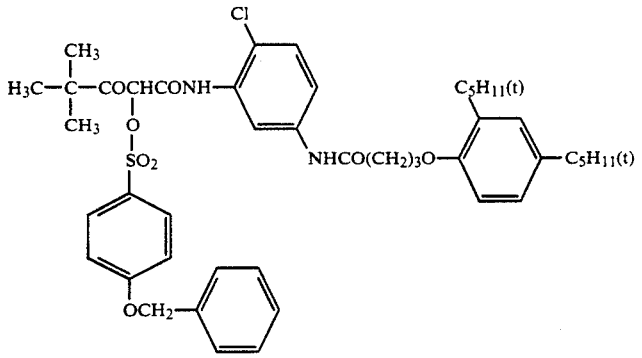
(Y-10)
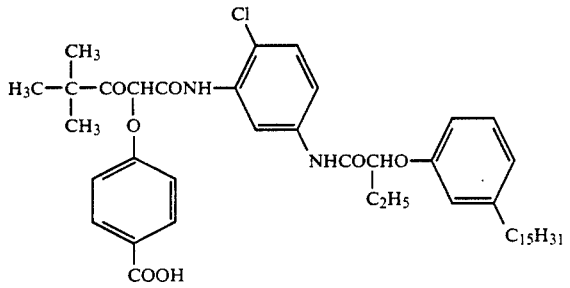
(Y-11)
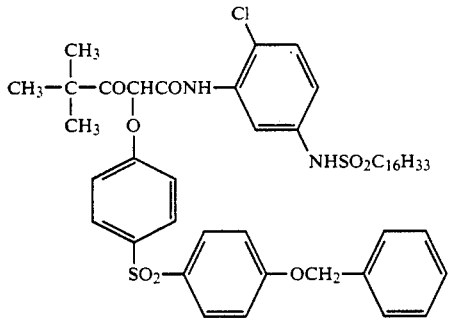
(Y-12)
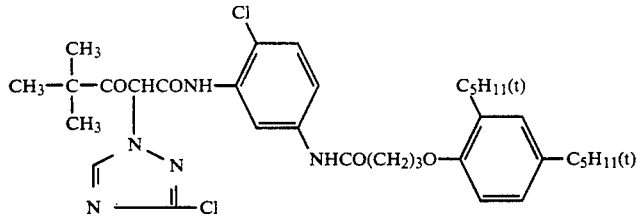
(Y-13)
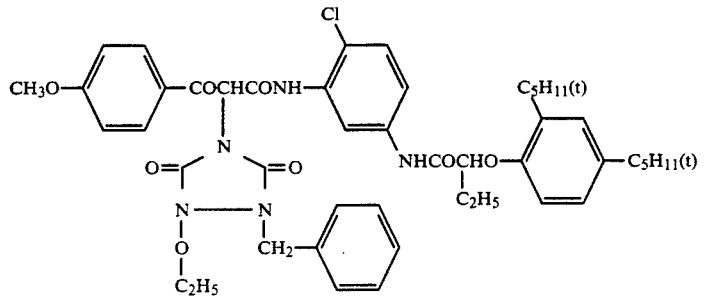

-continued (Y-14)

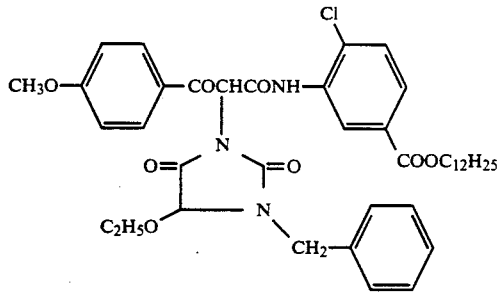

(Y-15)

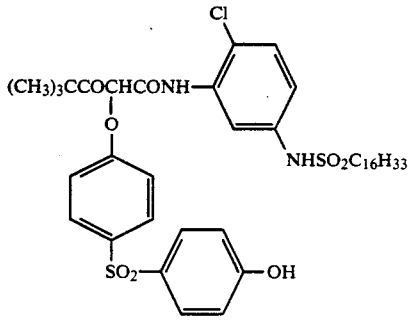

As the magenta color forming couplers to be used in the light-sensitive material of the present invention, it is possible to use pyrazolone type compounds, indazolone type compounds, cyanoacetyl compounds, pyrazolotriazole compounds, particularly advantageously pyrazolone type compounds.

Examples of the usable magenta color forming coupler include those disclosed in Japanese Provisional Patent Publication No. 111631/1974, Japanese Patent Publication No. 27930/1973, Japanese Provisional Patent Publication No. 29236/1981, U.S. Pat. Nos. 2,600,788, 3,062,653, 3,408,194 and 3,519,429, Japanese Provisional Patent Publication No. 94752/1982 and Research Disclosure No. 12443.

Particularly preferable couplers are shown below.

(M-1)

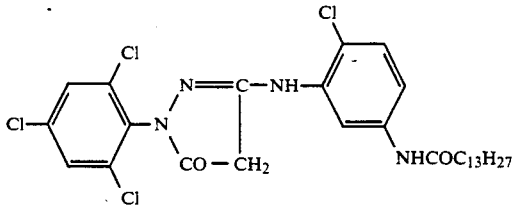

(M-2)

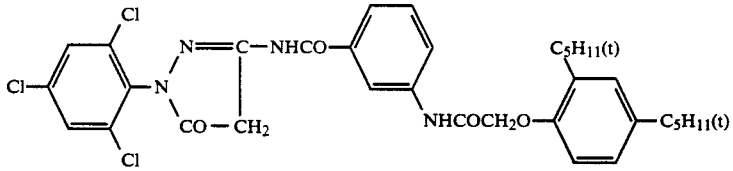

(M-3)

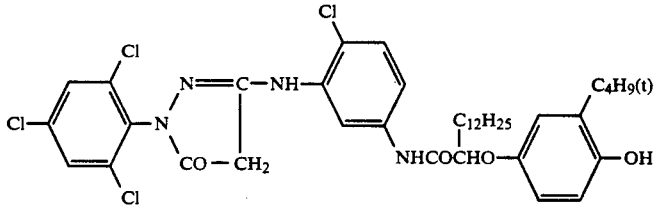

(M-4)

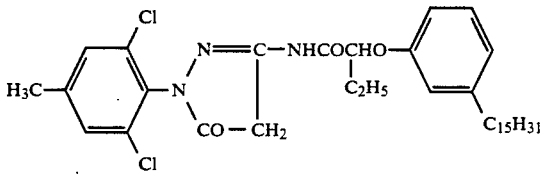

-continued
(M-5)
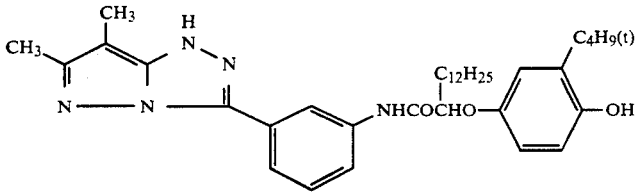
(M-6)
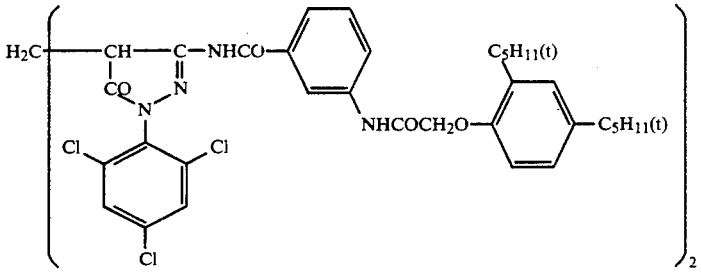
(M-7)
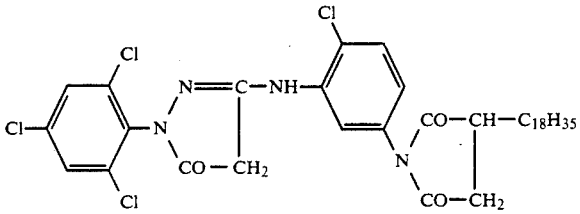
(M-8)
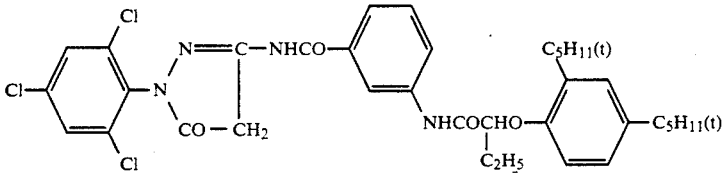
(M-9)
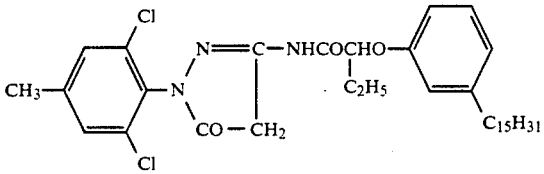
(M-10)
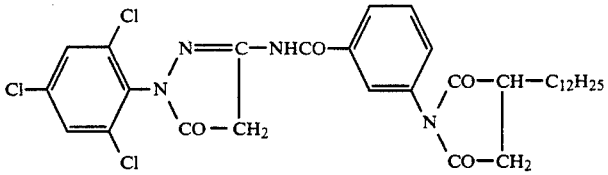
(M-11)
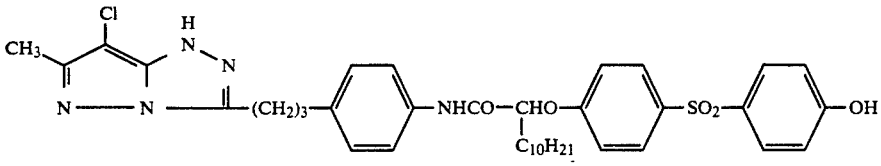
(M-12)
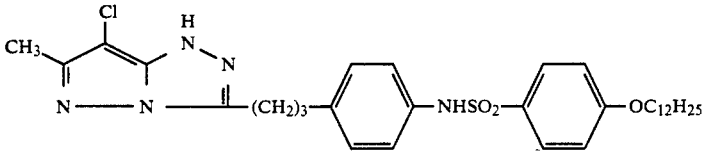

-continued (M-13)

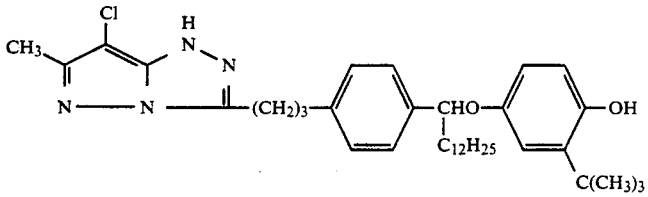

(M-14)

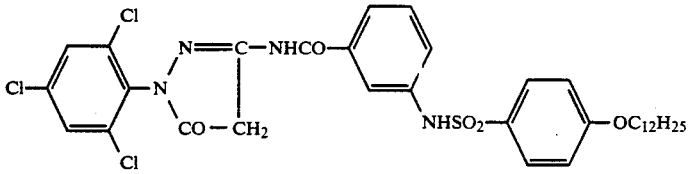

(M-15)

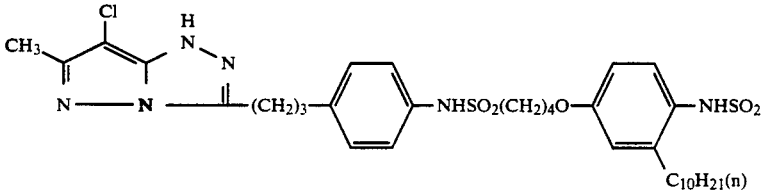

The cyan color forming couplers to be used in the light-sensitive material of the present invention may be phenol type compounds, naphthol type compounds, etc.

Its specific examples may include those disclosed in U.S. Pat. Nos. 2,423,730, 2,474,293 and 2,895,826 and Japanese Provisional Patent Publication No. 117422/1975.

Particularly preferable cyan color forming couplers are shown below.

(C-1)

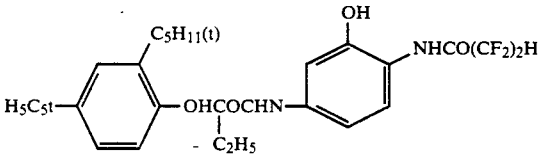

(C-2)

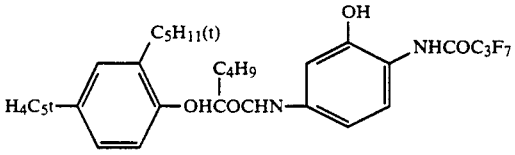

(C-3)

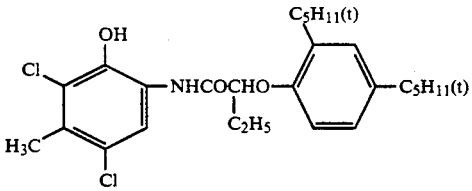

(C-4)

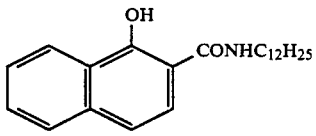

(C-5)

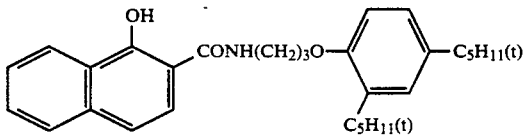

-continued
(C-6)
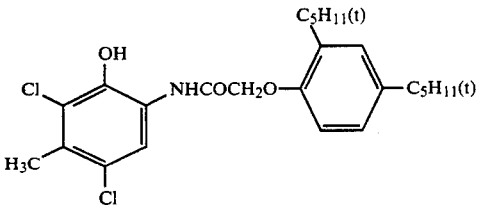
(C-7)
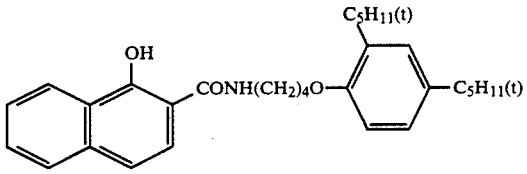
(C-8)
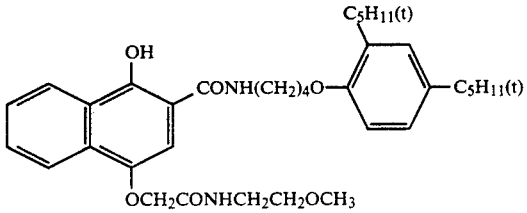
(C-9)
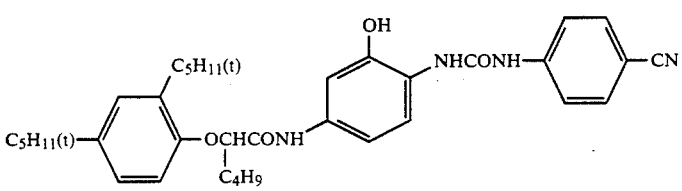
(C-10)
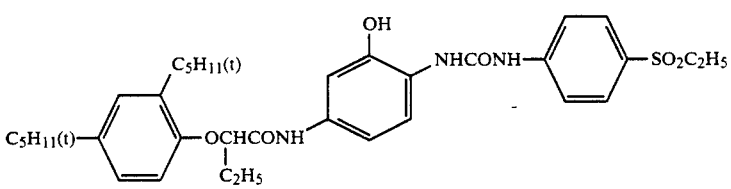
(C-11)
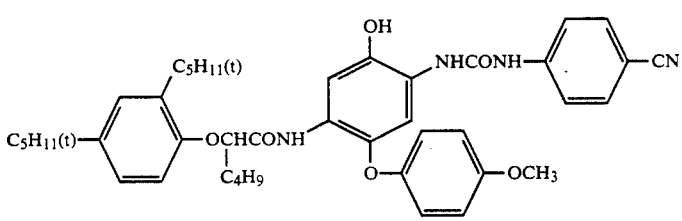
(C-12)
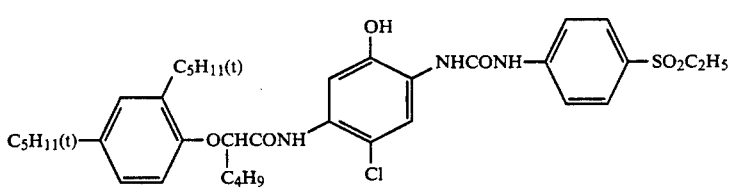
(C-13)
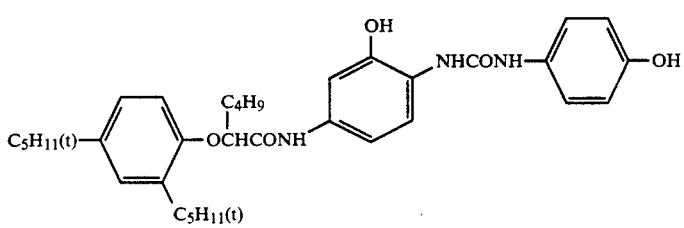

-continued (C-14)

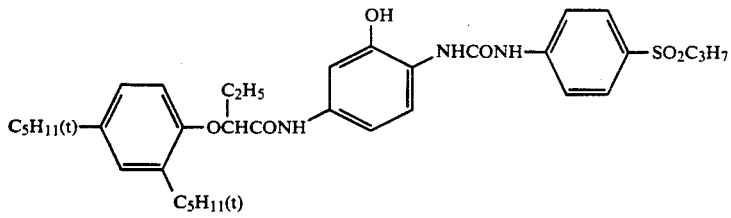

(C-15)

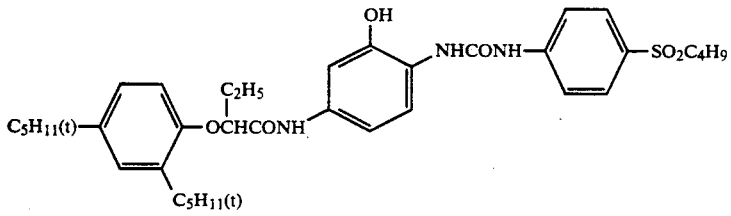

(C-16)

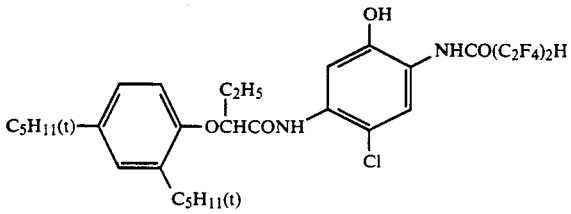

(C-17)

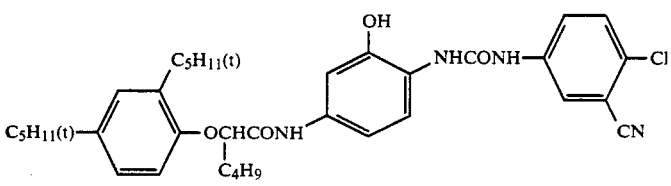

(C-18)

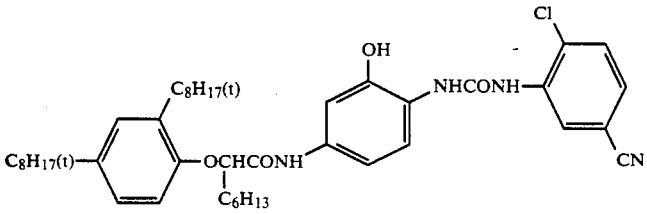

(C-19)

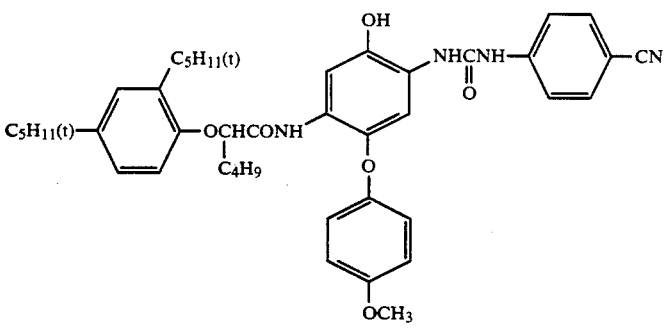

In the silver halide emulsion layer and other photographic constituent layers, it is also possible to use in combination with other couplers than the diffusive DIR compound of the present invention such as non-diffusive DIR compounds, non-diffusive couplers capable of forming an appropriately penetrable diffusive dye through the reaction with the oxidized product of a developing agent, polymer couplers and others. Non-diffusive DIR compounds, non-diffusive couplers capable of forming an appropriately penetrable diffusive dye through the reaction with the oxidized product of a developing agent are described in Japanese Provisional Patent Publication No. 72235/1986 by the present Applicant, while the polymer couplers in Japanese Provisional Patent Publication No. 50143/1986 by the present Applicant, respectively. The total amount of the couplers used in respective layers may be determined appropriately, since the maximum concentration differs depending on the individual color forming characteristics of the respective couplers, but it is preferred to use an amount of about 0.01 to 0.30 mole per mole of silver halide.

For incorporating these diffusive DIR compounds and couplers in the silver halide emulsion according to the present invention, when said diffusive DIR compounds and couplers are alkali-soluble, they may be added as alkaline solutions; when they are oil-soluble, they can preferably be dissolved in a high boiling point solvent, optionally together with a low boiling point solvent, according to the methods as disclosed in U.S. Pat. Nos. 2,322,027, 2,801,170, 2,801,171, 2,272,191 and 2,304,940, to be dispersed in fine particles before addition into the silver halide emulsion. If desired, a hydroquinone derivative, a UV-ray absorber, a color fading preventive, etc. may also be used in combination. Also, two or more kinds of couplers may be used as a mixture. Further, to describe in detail about the preferable method for addition of diffusive DIR compounds and couplers, one or two or more kinds of said diffusive DIR compounds and couplers, optionally together with other couplers, a hydroquinone derivative, a color fading preventive, a UV-ray absorber, etc., are dissolved in a high boiling point solvent such as organic acid amides, carbamates, esters, ketones, urea derivatives, ethers, hydrocarbons, specifically di-n-butylphthalate, tricresyl phosphate, triphenyl phosphate, di-iso-octylazelate, di-n-butylsebacate, tri-n-hexylphosphate, N,N-diethylcaprylamidobutyl, N,N-diethyllaurylamide, n-pentadecylphenylether, dioctylphthalate, n-nonylphenol, 3-pentadecylphenylethyl ether, 2,5-di-sec-amylphenylbutyl ether, monophenyl-di-o-chlorophenyl phosphate or fluoroparaffins, and/or a low boiling point solvent such as methyl acetate, ethyl acetate, propyl acetate, butyl acetate, butyl propionate, cyclohexanol, diethyleneglycol monoacetate, nitromethane, carbon tetrachloride, chloroform, cyclohexene, tetrahydrofuran, methyl alcohol, acetonitrile, dimethylformamide, dioxane, methyl ethyl ketone, etc., the resultant solution is mixed with an aqueous solution containing an anionic surfactant such as alkylbenzenesulfonic acid and alkylnaphthalenesulfonic acid and/or a nonionic surfactant such as sorbitane sesquioleic acid ester and sorbitane monolauryl acid ester and/or an aqueous solution containing a hydrophilic binder such as gelatin, etc., emulsified by means of a high speed rotary mixer, a colloid mill or a sonication dispersing device, etc. and added into the silver halide emulsion.

Otherwise, the above coupler may also be dispersed by use of the latex dispersing method. The latex dispersing method and its effect are described in Japanese Provisional Patent Publications No. 74538/1974, No. 59943/1976 and No. 32552/1979 and Research Disclosure No. 14850, August, 1976, pp. 77–79.

In the light-sensitive silver halide color photographic material of the present invention, various kinds of other additives for photography can be contained. For example, there can be employed color staining preventives as disclosed in Japanese Provisional Patent Publication No. 2128/1971 and U.S. Pat. No. 2,728,659, antifoggants, stabilizers, UV-ray absorbers, color staining preventives, color image fading preventives, antistatic agents, film hardeners, surfactants, plastifiers, wetting agents, etc. as disclosed in Research Disclosure No. 17643. In the light-sensitive silver halide color photographic material of the present invention, the hydrophilic colloid to be used for preparation of the emulsion may include any of gelatin, gelatin derivatives, graft polymer of gelatin with other polymers, proteins such as albumin, casein, etc., cellulose derivatives such as hydroxyethyl cellulose, carboxymethyl cellulose, etc., starch derivatives, synthetic hydrophilic homopolymers or copolymers such as polyvinyl alcohol, polyvinyl imidazole, polyacrylamide, etc.

As the support for light-sensitive silver halide color photographic material of the present invention, there may be employed, for example, baryta paper, polyethylene-coated paper, polypropylene synthetic paper, transparent supports provided with reflective layer or employing a reflective material in combination, such as glass plate, cellulose acetate, cellulose nitrate or polyester films such as polyethyleneterephthalate, polyamide filme, polycarbonate film, polystyrene film, etc. Further, conventional transparent supports may also be used, and these supports may be suitably selected depending on the purpose of use of the light-sensitive material.

For coating of the emulsion layers and other constituent layers to be used in the present invention, it is possible to use various coating methods such as dipping coating, air doctor coating, curtain coating, hopper coating, etc. Also, simultaneous coating of two or more layers can also be used as disclosed in U.S. Pat. Nos. 2,761,791 and 2,941,898.

The method for processing the light-sensitive photographic material according to the present invention is not particularly limited, but all processing methods conventionally known are applicable.

The color developing solution to be used in processing of the silver halide emulsion layer according to the present invention is an aqueous alkaline solution containing a color developing agent having a pH preferably of 8 or higher, more preferably of 9 to 12. The aromatic primary amine developing agent as the color developing agent is a compound having a primary amino group on the aromatic ring with an ability to develop the exposed silver halide, and further a precursor capable of forming such a compound may be added if necessary.

The silver halide fixing agent may include, for example, sodium thiosulfate, ammonium thiosulfate, potassium thiocyanate, sodium thiocyanate, or compounds capable of forming water-soluble silver salts through the reaction with silver halides conventionally used in fixing processing, such as thiourea, thioether, etc.

The light-sensitive silver halide color photographic material of the present invention may also be subjected to the stabilizing processing substituting for water washing as disclosed in Japanese Provisional Patent Publications No. 14834/1983, No. 105145/1983, No. 134634/1983, No. 18631/1983, No. 126533/1984 and No. 233651/1985.

According to the light-sensitive silver halide color photographic material of the present invention, by using the substantially monodispersed core/shell type silver halide grains or twinned crystal silver halide grains of the present invention, the I.I.E in both directions can be made greater between the different color-sensitive layers, whereby color reproducibility can be improved, particularly saturation (chroma) reproduction can be improved, and by suitable employment of the DIR compound to emphasize the I.I.E. in both directions, sharpness and graininess of image can also be improved.

Further, according to the present invention, a silver halide photographic material having good color reproducibility and excellent in stability with the lapse of time, particularly under high temperature and high humidity can be obtained.

EXAMPLES

The present invention is described in more detail by referring to the following Examples, but the embodiments of the present invention are not limited thereto.

Improved effect of sharpness of the image was evaluated by determining MTF (Modulation Transfer Function) and comparing size of the MTF value (MTF*G) of Green density at space frequencies of 20 cycle/mm.

Further, each graininess (RMS) was represented by a value 1,000 times as much as standard deviations of a variation of a concentration value obtained when a dye image having a color image concentration of 1.0 was scanned by a microdensitometer having a circular scanning aperture of 25 μm.

Also, in all the Examples shown below, amounts added in the light-sensitive silver halide color photographic material are indicated in amounts per 1 $m^2$, and the silver halide and colloidal silver calculated on silver.

EXAMPLE 1

Silver iodobromide emulsions shown in Table 4 were prepared according to the prepartive method shown below. Em - 1 was prepared by the conventional double jet method. Em - 2 to Em - 7 were prepared by the function addition method to prepare core/shell type monodispersed emulsions.

TABLE 4

| | Average grain diameter (μm) | Proportion of silver halide grains contained within the range of r ± 20% (wt. %) | Content of average silver iodide (mole %) | Content of silver iodide in core (mole %) | Content of silver iodide in shell (mole %) | Volume proportion of shell (%) |
|---|---|---|---|---|---|---|
| Em-1 | 0.46 | 55. | 6 | — | — | — |
| Em-2 | 0.46 | 87 | 7 | 10 | 4 | 50 |
| Em-3 | 0.46 | 83 | 6 | 10 | 2 | 50 |
| Em-4 | 0.43 | 82 | 8.5 | 15 | 2 | 50 |
| Em-5 | 0.43 | 90 | 7.75 | 15 | 0.5 | 50 |
| Em-6 | 0.48 | 86 | 8.03 | 22 | 0.5 | 65 |
| Em-7 | 0.48 | 84 | 8.9 | 34 | 0.5 | 75 |

Onto a cellulose triacetate support, the following respective layers were successively coated to prepare a multi-layer color film sample.

Layer 1 ... Halation preventive layer (HC layer):

A halation preventive layer comprising 0.18 g of black colloidal silver and 1.5 g of gelatin.

Layer 2 ... Subbing layer (1G layer):

A subbing layer comprising 2.0 g of gelatin.

Layer 3 ... Low sensitivity layer of red-sensitive silver halide emulsion layer (RL layer):

A low sensitivity layer of a red-sensitive silver halide emulsion layer containing a dispersion emulsified and dispersed in an aqueous solution containing 1.80 g of gelatin, 1.4 g of the Em (any one of Em - 1 to Em - 6) shown in Table 4 each color sensitized to red-sensitive, 0.08 mole/mole Ag of a cyan coupler of the exemplary compound (C - 7), 0.006 mole/mole Ag of a colored cyan coupler of the exemplary compound (CC - 1) and a DIR compound indicated in Table 5 dissolved in 0.5 g of tricresyl phosphate (called TCP).

Layer 4 ... Intermediate layer (2G layer):

An intermediate layer comprising 0.14 g of 2,5-di-t-butylhydroquinone and 0.07 g of dibutylphthalate (called DBP).

Layer 5 ... Low sensitivity layer of green-sensitive silver halide emulsion layer (GL layer):

A low sensitivity layer of a green-sensitive silver halide emulsion layer containing a dispersion emulsified and dispersed in an aqueous solution containing 1.4 g of gelatin, 1.1 g of the Em (any one of Em - 1 to Em - 6) shown in Table 4 each color sensitized to green-sensitive, 0.07 mole/mole Ag of a magenta coupler of the exemplary compound (M - 2), 0.015 mole/mole Ag of a colored magenta coupler of the exemplary compound (CM - 5) and a DIR compound indicated in Table 5 dissolved in 0.64 g of TCP.

Layer 6 .. Protective layer (3G layer):

A protective layer containing 0.8 g of gelatin.

In the respective layers, in addition to those as mentioned above, there were incorporated gelatin hardeners (1,2-bisvinylsulfonylethane) and surfactants therein. Samples No. 1 to No. 11 containing the silver halide emulsions indicated in Table 4 and the DIR compounds indicated in Table 5 added into the RL layer of Layer 3 and the GL layer of Layer 5 were prepared.

Each sample was given green light, red light or green light+red light through a wedge, and processed according to the following processing steps to obtain a dye image.

| Processing steps (38° C.): | |
|---|---|
| Color developing | 2 min. 40 sec. |
| Bleaching | 6 min. 30 sec. |
| Water washing | 3 min. 15 sec. |
| Fixing | 6 min. 30 sec. |
| Water washing | 3 min. 15 sec. |
| Stabilizing | 3 min. 15 sec. |
| Drying | |

The processing solutions used in the respective processing steps had the following compositions.

| | |
|---|---|
| [Color developing solution] | |
| 4-Amino-3-methyl-N-ethyl-N-(β-hydroxyethyl)aniline.sulfate | 4.75 g |
| Anhydrous sodium sulfite | 4.25 g |
| Hydroxylamine.½ sulfate | 2.0 g |
| Anhydrous potassium carbonate | 37.5 g |
| Sodium bromide | 1.3 g |
| Trisodium nitrilotriacetate (monohydrate) | 2.5 g |
| Potassium hydroxide | 1.0 g |
| (made up to one liter with addition of water). | |
| [Bleaching solution] | |
| Ferric ammonium ethylenediamine-tetraacetate | 100.0 g |
| Diammonium ethylenediamine-tetraacetate | 10.0 g |
| Ammonium bromide | 150.0 g |
| Glacial acetic acid | 10.0 ml |
| (made up to one liter with addition of water, and | |

-continued

| | |
|---|---|
| adjusted to pH = 6.0 with aqueous ammonia). | |
| [Fixing solution] | |
| Ammonium thiosulfate | 175.0 g |
| Anhydrous sodium sulfite | 8.5 g |
| Sodium metasulfite | 2.3 g |
| (made up to one liter with addition of water, and adjusted to pH = 6.0 with acetic acid). | |
| [Stabilizing solution] | |
| Formalin (37% aqueous solution) | 1.5 ml |
| Konidax (trade name, produced by Konishiroku Photo Industry K.K.) | 7.5 ml |
| (made up to one liter with addition of water). | |

The characteristic values obtained are shown in Table 5. The amount of the DIR compound added into each color-sensitive layer is controlled so that sensitivity reduction and density lowering in its own layer may be substantially equal to each other.

TABLE 5

| Sample No. | Green-sensitive silver halide emulsion layer: Emulsion | Compound | Added amount ($\times 10^{-2}$ mole/mole Ag) | Red sensitive silver halide emulsion layer: Emulsion | Compound | Added amount ($\times 10^{-2}$ mole/mole Ag) | I.I.E. ($\gamma A/\gamma N$) G | R | RMS G | R | Remark |
|---|---|---|---|---|---|---|---|---|---|---|---|
| 1 | Em-1 | D-11 | 0.4 | Em-1 | D-14 | 0.5 | 1.15 | 1.15 | 42 | 30 | Comparative |
| 2 | Em-1 | D-11 | 0.4 | Em-2 | D-14 | 0.5 | 1.20 | 1.25 | 40 | 25 | This invention |
| 3 | Em-2 | D-11 | 0.4 | Em-1 | D-14 | 0.5 | 1.25 | 1.20 | 33 | 28 | This invention |
| 4 | Em-2 | D-11 | 0.4 | Em-2 | D-14 | 0.5 | 1.53 | 1.57 | 30 | 23 | This invention |
| 5 | Em-2 | D-14 | 0.3 | Em-2 | D-11 | 0.25 | 1.19 | 1.17 | 31 | 28 | Comparative |
| 6 | Em-2 | D-4 | 0.25 | Em-2 | D-3 | 0.15 | 1.25 | 1.27 | 33 | 29 | Comparative |
| 7 | Em-2 | D-13 | 0.6 | Em-2 | D-13 | 0.6 | 1.21 | 1.25 | 32 | 27 | Comparative |
| 8 | Em-2 | D-4 | 0.25 | Em-2 | D-13 | 0.6 | 1.45 | 1.51 | 30 | 24 | This invention |
| 9 | Em-2 | D-11 | 0.4 | Em-3 | D-14 | 0.5 | 1.54 | 1.55 | 29 | 23 | This invention |
| 10 | Em-4 | D-11 | 0.4 | Em-4 | D-58 | 0.5 | 1.55 | 1.53 | 30 | 25 | This invention |
| 11 | Em-5 | D-13 | 0.4 | Em-5 | D-14 | 0.5 | 1.52 | 1.51 | 28 | 22 | This invention |

When the $\gamma^*$ of the sample exposed to green light measured by green light is expressed as $\gamma AG$, while $\gamma^*$ when exposed to green light+red light is as $\gamma NG$, $\gamma AG/\gamma NG$ represents the greatness of I.I.E. received by the green-sensitive silver halide emulsion layer. Similarly, when the $\gamma^*$ of the sample exposed to red light measured by red light is expressed as $\gamma AR$, while $\gamma^*$ when exposed to green light+red light is as $\gamma NR$, $\gamma AR/\gamma NR$ represents the greatness of I.I.E. received by the red-sensitive silver halide emulsion. As the I.I.E received is greater, $\gamma A/\gamma N$ becomes greater.

$\gamma^*$: when the density at the point of dose which is ten-fold ($\Delta \log E=1.0$) of the dose at the density point with fog of +0.3 is D, $\gamma=\{D-(fog+0.3)\}/1.0$.

As is apparent from Table 5, each DIR compound is added so that the self-layer developing inhibiting power in each layer alone may be substantially equal, and the amount added clearly shows that the combination of the present invention is smaller in the self-layer developing inhibiting power (added in larger amount), with the I.I.E. mutually between the color-sensitive layer also becoming greater. Also, with respect to graininess, by using the aforesaid emulsion and further combining the above DIR compound, improved effects can be seen and thus, the effectiveness of the present invention is exhibited.

EXAMPLE 2

Onto a cellulose triacetate support, the following respective layers were successively coated to prepare a multi-layer color film sample.

Layer 1 .. Halation preventive layer (HC layer):

A halation preventive layer comprising 0.24 g of black colloidal silver and 1.7 g of gelatin.

Layer 2 ... Interception layer (IL layer):

A interception layer comprising 0.14 g of 2,5-di-t-butylhydroquinone, 0.07 g of DBP and 0.8 g of gelatin.

Layer 3 ... Low sensitivity layer of red-sensitive silver halide emulsion layer (RL layer):

A low sensitivity layer of a red-sensitive silver halide emulsion layer containing a dispersion emulsified and dispersed in an aqueous solution containing 1.80 g of gelatin, 1.4 g of the Em indicated in the above Table 4 each color sensitized to red-sensitive, 0.65 g of a cyan coupler of the exemplary compound (C - 17), 0.05 g of a colored cyan coupler of the exemplary compound (CC - 1) and a DIR compound indicated in Table 6 dissolved in 0.53 g of TCP.

Layer 4 ... High sensitivity layer of red-sensitive silver halide emulsion layer (RH layer):

A high sensitivity layer of red-sensitive silver halide emulsion layer containing a dispersion emulsified and dispersed in an aqueous solution, 0.9 g of an emulsion having an average grain size of 0.8 μm and comprising AgBrI containing 6 mole % of AgI (emulsion II) color sensitized to red-sensitive and 0.21 g of a cyan coupler of the exemplary compound (C - 8) dissolved in 0.21 g of TCP with 1.2 g of gelatin.

Layer 5 ... Interception layer (IL layer):

The same as the IL layer of the above Layer 2.

Layer 6 .. Low sensitivity layer of green-sensitive silver halide emulsion layer (GL layer):

A low sensitivity layer of a green-sensitive silver halide emulsion layer containing a dispersion emulsified and dispersed in an aqueous solution containing 1.4 g of gelatin, 1.1 g of the Em indicated in the above Table 4 each color sensitized to green-sensitive, 0.52 g of a magenta coupler of the exemplary compound (M - 2), 0.12 g of a colored magenta coupler of the exemplary compound (CM - 5) and a DIR compound indicated in Table 6 dissolved in 1.5 g of TCP.

Layer 7 ... High sensitivity layer of green-sensitive silver halide emulsion layer (GH layer):

A high sensitivity layer of a green-sensitive silver halide emulsion layer containing a dispersion emulsified and dispersed in an aqueous solution containing 1.2 g of gelatin, 0.9 g of the emulsion II color sensitized to green-sensitive, 0.28 g of a magenta coupler of the exemplary compound (M - 12) and 0.05 g of a colored magenta coupler of the exemplary compound (CM - 5) dissolved in 0.33 g of TCP.

Layer 8 .. Yellow filter layer (YC layer):

A yellow filter layer containing 0.12 g of 2,5-di-t-butylhydroquinone and 0.9 g of gelatin.

Layer 9 ... Low sensitivity layer of blue-sensitive silver halide emulsion layer:

A low sensitivity layer of a green-sensitive silver halide emulsion layer containing a dispersion emulsified and dispersed in an aqueous solution containing 1.2 g of gelatin, 0.5 g of the Em indicated in the above Table 4 each color sensitized to blue-sensitive, 1.0 g of a yellow coupler of the exemplary compound (Y - 4) and a DIR compound indicated in Table 6 dissolved in 0.14 g of TCP.

Layer 10 ... High sensitivity layer of blue-sensitive silver halide emulsion layer (GH layer):

A high sensitivity layer of a blue-sensitive silver halide emulsion layer containing a dispersion emulsified and dispersed in an aqueous solution containing 1.2 g of gelatin, 0.5 g of the emulsion II color sensitized to blue-sensitive and 0.75 g of a yellow coupler of the exemplary compound (Y - 4) dissolved in 0.08 g of TCP.

Layer 11 .. Protective layer (PL layer):

A protective layer containing 1.3 g of gelatin.

The thus prepared Sample No. 15 was then modified as shown in the following Table 6 to prepare Samples No. 16 to No. 24(b).

In the respective layers, there were incorporated gelatin hardeners and surfactants.

Each of the above Samples No. 15 to No. 24(b) was given blue light, green light, red light and white light through a wedge, and processed in the same manner as Example 1 except for changing the developing time to 3 min. and 15 sec. to obtain a dye image. The results are shown in Table 6 similarly as Example 1.

As is apparent from Table 6, the Samples No. 18 to No. 20, No. 23 and No. 24 of the present invention are very great in γA/γN in respective color-sensitive layers as compared with Control samples, thus enabling reproduction of high chroma color. Also, MTF with the green light which is most sensitive to human eyes is high, whereby an image of high sharpness can be reproduced.

Separately from the above exposure, a landscape was actually photographed with the use of Samples No. 15 to No. 24(b), and the images printed on color paper were compared with each other. As a result, the samples of the present invention gave sharper images than expected with very bright colors and good MTF values. This may be considered due to the synergetic effect of brightness of color and sharpness.

Also, in both Examples 1 and 2, in addition to the use of the monodispersed silver halide grains, each DIR compound is added in an amount so that the self-layer developing inhibiting power may be substantially equal in each layer alone and, from the value of the amount of the DIR compound, the combination of the present invention is clearly smaller in self-layer developing inhibiting power (useable in greater amount), whereby it is clarified that I.I.E mutually between the color-sensitive layers has become greater, sharpness has remarkably enhanced and graininess has also improved.

EXAMPLE 3

Silver iodobromide emulsions indicated in Table 7 were prepared by the methods as disclosed in Japanese Provisional Patent Publications No. 118823/1979, No. 113928/1983 and No. 211143/1983 and by the conventional function addition method.

TABLE 6

| Sample | DIR compound (amount added, $\times 10^{-2}$ mole/mole Ag) | | | | | | | | | Photographic characteristics | | | | |
|---|---|---|---|---|---|---|---|---|---|---|---|---|---|---|
| | Blue-sensitive silver halide emulsion layer | | | Green-sensitive silver halide emulsion layer | | | Red-sensitive silver halide emulsion layer | | | (γA/γN) | | | MTF*G | |
| No. | BH | (Em) | BL | GH | (Em) | GL | RH | (Em) | RL | B | G | R | (%) | Remark |
| 15 | — | Em-2 | D-13 (0.4) | — | Em-2 | D-13 (0.5) | — | Em-2 | D-5 (0.5) | 1.15 | 1.21 | 1.23 | 85 | Comparative |
| 16 | — | Em-2 | D-13 (0.4) | — | Em-2 | D-13 (0.3) | — | Em-2 | D-16 (0.25) | 1.18 | 1.18 | 1.19 | 83 | Comparative |
| 17 | — | Em-1 | D-13 (0.4) | — | Em-1 | D-11 (0.4) | — | Em-1 | D-5 (0.5) | 1.10 | 1.15 | 1.20 | 80 | Comparative |
| 18 | — | Em-2 | D-13 (0.4) | — | Em-2 | D-11 (0.4) | — | Em-2 | D-5 (0.5) | 1.32 | 1.45 | 1.50 | 90 | This invention |
| 19 | — | Em-2 | D-13 (0.4) | — | Em-2 | D-11 (0.4) | — | Em-2 | D-5 (0.45) | 1.30 | 1.47 | 1.55 | 94 | This invention |
| 20 | — | Em-2 | D-13 (0.4) | D-11 (0.25) | Em-2 | D-11 (0.4) | D-15 (0.05) | Em-2 | D-5 (0.45) | 1.33 | 1.51 | 1.58 | 96 | This invention |
| 21 | — | Em-2 | D-4 (0.3) | — | Em-2 | D-4 (0.25) | — | Em-2 | D-4 (0.15) | 1.20 | 1.32 | 1.28 | 88 | Comparative |
| 22 | — | Em-1 | D-13 (0.4) | — | Em-1 | D-4 (0.25) | — | Em-1 | D-5 (0.5) | 1.15 | 1.28 | 1.25 | 84 | Comparative |
| 23 | — | Em-2 | D-13 (0.4) | — | Em-2 | D-4 (0.25) | — | Em-2 | D-5 (0.5) | 1.22 | 1.39 | 1.42 | 93 | This invention |
| 24 | — | Em-5 | D-13 (0.4) | — | Em-2 | D-11 (0.4) | — | Em-3 | D-15 (0.45) | 1.21 | 1.39 | 1.38 | 94 | This invention |
| 24a | — | Em-2 | D-13 (0.4) | — | Em-6 | D-11 (0.4) | — | Em-2 | D-15 (0.45) | 1.29 | 1.43 | 1.48 | 91 | This invention |
| 24b | — | Em-2 | D-13 (0.4) | — | Em-7 | D-11 (0.4) | — | Em-2 | D-15 (0.45) | 1.28 | 1.41 | 1.50 | 92 | This invention |

TABLE 7

| Emulsion No. | Average grain diameter (μm) | Average aspect ratio | U value | Content of iodide in total grain (mole %) | Content of iodide in core (mole %) | Content of iodide in shell (mole %) | Volume proportion of shell (%) | Remark |
|---|---|---|---|---|---|---|---|---|
| A | 0.46 | — | 92 | 7 | 10 | 2 | 50 | Tetra-decahedral |
| B | 0.46 | 3:1 | 85 | 7 | — | — | — | Twinned crystal |
| C | 0.9 | 12:1 | 51 | 7 | — | — | — | Twinned crystal |
| D | 0.8 | 5:1 | 82 | 7 | — | — | — | Twinned crystal |
| E | 0.8 | 4:1 | 79 | 7 | 10 | 2 | 45 | Twinned crystal |
| F | 0.75 | 5:1 | 80 | 4 | — | — | — | Twinned crystal |
| G | 0.85 | 6:1 | 59 | 7 | — | — | — | Twinned crystal |

Onto a cellulose triacetate support, the following respective layers were successively coated to prepare a multi-layer color negative photographic material (Sample No. 25, Comparative).

| | |
|---|---|
| Layer 1 Halation preventive layer: | |
| Black colloidal silver | 0.17 g/m$^2$ |
| UV-ray absorber VV-1 emulsified and dispersed material | 0.1 g/m$^2$ |
| Gelatin | 1.5 g/m$^2$ |
| Layer 2 Intermediate layer: | |
| Gelatin | 1.2 g/m$^2$ |
| Layer 3 Low sensitivity layer of red-sensitive emulsion layer: | |
| Silver iodobromide emulsion A indicated in Table 7 sensitized by | |
| Sensitizing dye-I | 0.168 g/mole Ag |
| Sensitizing dye-II | 0.017 g/mole Ag |
| Sensitizing dye-III | 0.120 g/mole Ag |
| with gold and sulfur | 1.4 g/m$^2$ (coated silver amount) |
| Coupler C-1 | 5.7 × 10$^{-3}$ mole/mole Ag |
| Coupler C-2 | 0.1 mole/mole Ag |
| DIR D-1 | 0.5 × 10$^{-3}$ mole/mole Ag |
| Diffusive DIR exemplary compound D-5 | 2 × 10$^{-3}$ mole/mole Ag |
| Dispersing solvent HBS-1 | 0.53 g/m$^2$ |
| Gelatin | 1.4 g/m$^2$ |
| Layer 4 High sensitivity layer of red-sensitive emulsion layer: | |
| Silver iodobromide emulsion C indicated in Table 7 sensitized by | |
| Sensitizing dye-I | 0.123 g/mole Ag |
| Sensitizing dye-II | 0.127 g/mole Ag |
| Sensitizing dye-III | 0.109 g/mole Ag |
| with gold and sulfur | 1.1 g/m$^2$ (coated silver amount) |
| Coupler C-1 | 2.4 × 10$^{-3}$ mole/mole Ag |
| Coupler C-3 | 4.5 × 10$^{-3}$ mole/mole Ag |
| Coupler C-4 | 1.6 × 10$^{-2}$ mole/mole Ag |
| DIR D-1 | 3.3 × 10$^{-4}$ mole/mole Ag |
| Diffusive DIR exemplary compound D-5 | 1 × 10$^{-3}$ mole/mole Ag |
| Dispersing solvent HBS-2 | 0.16 g/m$^2$ |
| Gelatin | 0.93 g/m$^2$ |
| Layer 5 Intermediate layer: | |
| Gelatin | 0.80 g/m$^2$ |
| Layer 6 Low sensitivity layer of green-sensitive emulsion layer: | |
| Silver iodobromide emulsion A indicated in Table 7 sensitized by | |
| Sensitizing dye-IV | 0.20 g/mole Ag |
| Sensitizing dye-V | 0.15 g/mole Ag |
| Sensitizing dye-VI | 0.14 g/mole Ag |
| with gold and sulfur | 1.1 g/m$^2$ (coated silver amount) |
| Coupler C-5 | 0.01 mole/mole Ag |
| Coupler C-6 | 0.03 mole/mole Ag |
| Coupler C-7 | 0.07 mole/mole Ag |
| DIR D-3 | 0.0005 mole/mole Ag |
| Diffusive DIR exemplary compound D-13 | 4 × 10$^{-3}$ mole/mole Ag |
| Dispersing solvent HBS-2 | 0.9 g/m$^2$ |

-continued

| | |
|---|---|
| Gelatin | 1.4 g/m$^2$ |
| Layer 7 High sensitivity layer of green-sensitive emulsion layer: | |
| Silver iodobromide emulsion C indicated in Table 7 sensitized by | |
| Sensitizing dye-IV | 0.15 g/mole Ag |
| Sensitizing dye-V | 0.12 g/mole Ag |
| Sensitizing dye-VI | 0.11 g/mole Ag |
| with gold and sulfur | 1.2 g/m$^2$ (coated silver amount) |
| Coupler C-5 | 0.015 mole/mole Ag |
| Coupler C-6 | 0.003 mole/mole Ag |
| Coupler C-7 | 0.007 mole/mole Ag |
| Diffusive DIR exemplary compound D-13 | 1.5 × 10$^{-3}$ mole/mole Ag |
| Dispersing solvent HBS-2 | 0.3 g/m$^2$ |
| Gelatin | 0.70 g/m$^2$ |
| Layer 8 Yellow filter layer: | |
| Yellow colloidal silver | 0.75 g/m$^2$ |
| Contamination preventive agent HQ-1 | 0.07 g/m$^2$ |
| Gelatin | 0.85 g/m$^2$ |
| Layer 9 Low sensitivity layer of blue-sensitive emulsion layer: | |
| Silver iodobromide emulsion A indicated in Table 7 sensitized by gold and sulfur | 0.50 g/m$^2$ (coated silver amount) |
| Coupler C-8 | 0.36 mole/mole Ag |
| Diffusive DIR exemplary compound D-13 | 6 × 10$^{-3}$ mole/mole Ag |
| Dispersing solvent HBS-2 | 0.15 g/m$^2$ |
| Gelatin | 1.7 g/m$^2$ |
| Layer 10 High sensitivity layer of blue-sensitive emulsion layer: | |
| Silver iodobromide emulsion C indicated in Table 7 sensitized by gold and sulfur | 0.50 g/m$^2$ (coated silver amount) |
| Coupler C-8 | 0.13 mole/mole Ag |
| Dispersing solvent BS-2 | 0.05 g/m$^2$ |
| Gelatin | 1.1 g/m$^2$ |
| Layer 11 First protective layer: | |
| UV-ray absorber VV-1 emulsified dispersant | 6.35 g/m$^2$ |
| Fine particle silver iodobromide emulsion | 4.5 × 10$^{-3}$ g/m$^2$ (coated silver amount) |
| Average grain diameter 0.08 μm | |
| Average silver iodide content 4 mole % | |
| Gelatin | 0.80 g/m$^2$ |
| Layer 12 Second protective layer: | |
| Polymethyl methacylate particle (Diameter-2.5 μm) | 100 mg/m$^2$ |
| Gelatin | 0.55 g/m$^2$ |

In the respective emulsion layers, in addition to the compositions as mentioned above, there were incorporated 4-hydroxy-6-methyl-1,3,3a,7-tetrazaindene, 1-phenyl-5-mercaptotetrazole and the like, also in the respective layers, in addition to the compositions as mentioned above, there were incorporated gelatin hardeners H - 1 and H - 2, and surfactants therein. Further, to the 3rd, 4th, 6th, 7th, 9th and 10th layers, as indicated in Table 8, emulsions in Table 7 and diffusive DIR exemplary compounds were added to prepare Samples 26 to 35. The amount of the diffusive DIR compound added into each color-sensitive layer is controlled so that sensitivity reduction and density lowering in its own layer may be substantially equal to each other.

VV-1

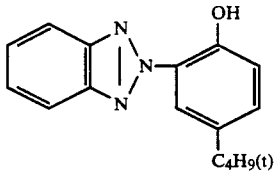

Sensitizing dye-I

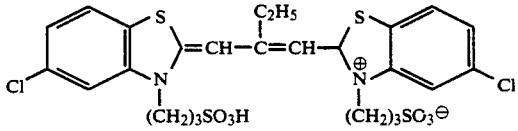

Sensitizing dye-II

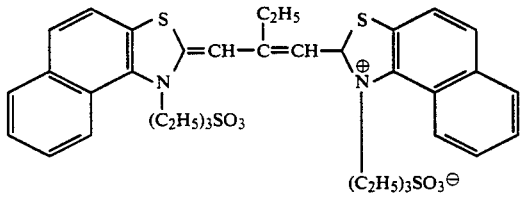

Sensitizing dye-III

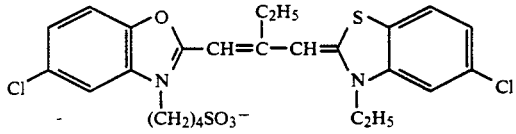

C-1

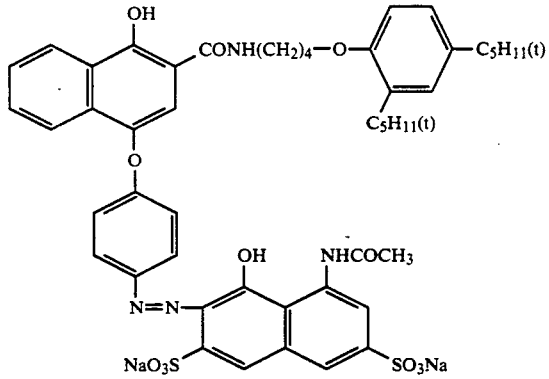

C-2

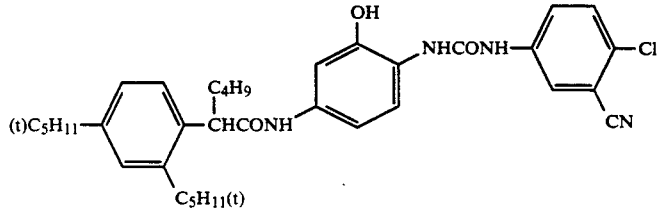

D-1

-continued
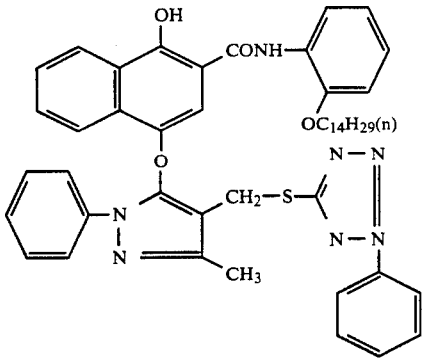
C-3
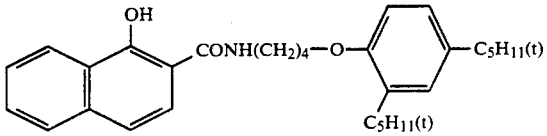
C-4
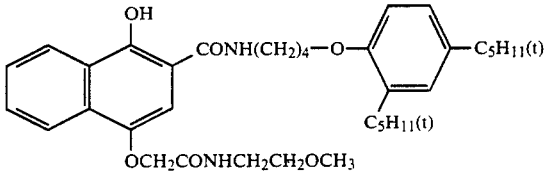
HBS-1
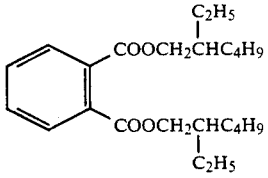
HBS-2
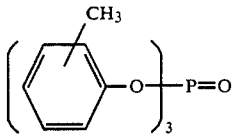
Sensitizing dye-IV
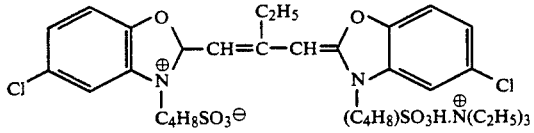
Sensitizing dye-V
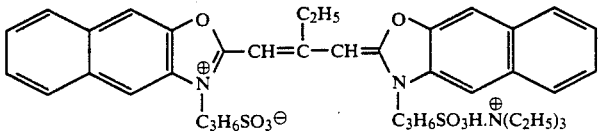
Sensitizing dye-VI -continued
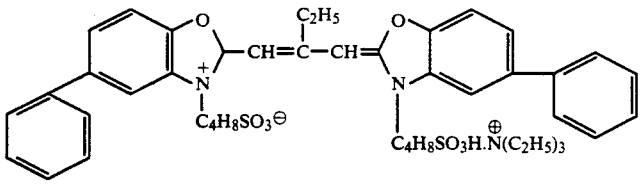
C-5
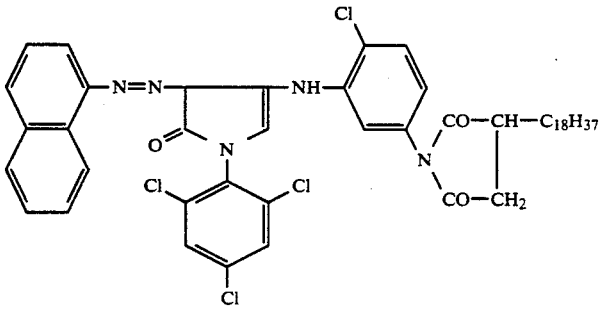
C-6
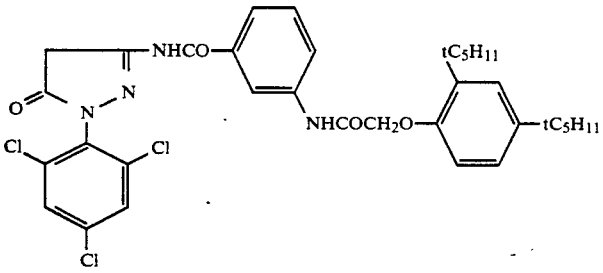
C-7
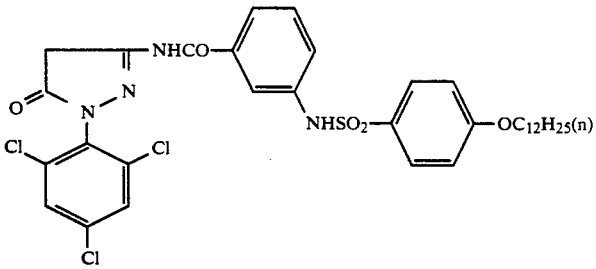
D-3
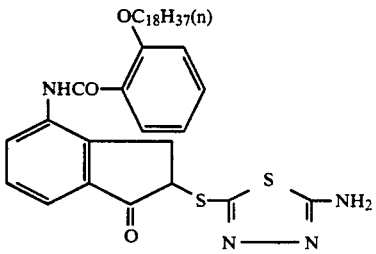
C-8

-continued

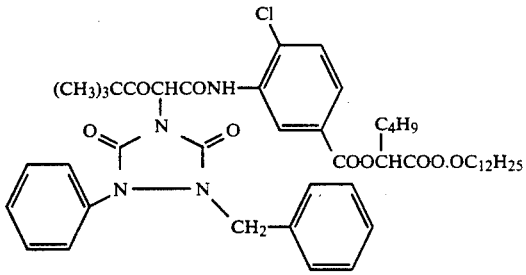

H-1

$CH_2{=}CHCH_2CH_2SO_2CH{=}CH_2$

H-2

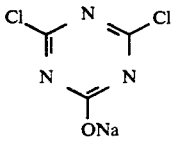

HQ-1

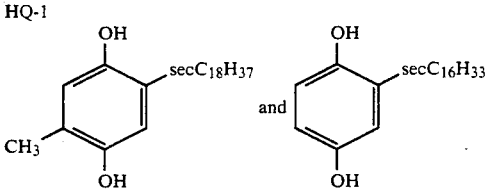

Each sample was given blue light, green light, red light and white light through a wedge, and processed according to the following processing steps to obtain a dye image.

| Processing steps (38° C.): | Processing time |
|---|---|
| Color developing | 2 min. 40 sec. |
| Bleaching | 6 min. 30 sec. |
| Water washing | 3 min. 15 sec. |
| Fixing | 6 min. 30 sec. |
| Water washing | 3 min. 15 sec. |
| Stabilizing | 1 min. 30 sec. |
| Drying | |

The processing solutions used in the respective processing steps had the following compositions.

| | |
|---|---|
| [Color developing solution] | |
| 4-Amino-3-methyl-N-ethyl-N-(β-hydroxyethyl)aniline.sulfate | 4.75 g |
| Anhydrous sodium sulfite | 4.25 g |
| Hydroxylamine.½ sulfate | 2.0 g |
| Anhydrous potassium carbonate | 37.5 g |
| Sodium bromide | 1.3 g |
| Trisodium nitrilotriacetate (monohydrate) | 2.5 g |
| Potassium hydroxide | 1.0 g |
| (made up to one liter with addition of water, and adjusted to pH = 10.0). | |
| [Bleaching solution] | |
| Ferric ammonium ethylenediamine-tetraacetate | 100.0 g |
| Diammonium ethylenediamine-tetraacetate | 10.0 g |
| Ammonium bromide | 150.0 g |
| Glacial acetic acid | 10.0 g |
| (made up to one liter with addition of water, and adjusted to pH = 6.0). | |
| [Fixing solution] | |

-continued

| | |
|---|---|
| Ammonium thiosulfate (50% aqueous solution) | 162 ml |
| Anhydrous sodium sulfite | 12.4 ml |
| (made up to one liter with addition of water, and adjusted to pH = 6.5). | |
| [Stabilizing solution] | |
| Formalin (37% aqueous solution) | 5.0 ml |
| Konidax (trade name, produced by Konishiroku Photo Industry K.K.) | 7.5 ml |
| (made up to one liter with addition of water). | |

The characteristic values obtained are shown in Table 8.

When the $\gamma^*$ of the sample exposed to white light measured by white light is expressed as $\gamma N$, while $\gamma^*$ when exposed to each blue light, green light and red light is as $\gamma A$, $\gamma A/\gamma N$ represents the greatness of I.I.E. received by the respective silver halide emulsion layer. As the I.I.E received is greater, $\gamma A/\gamma N$ becomes greater.

$\gamma^*$: when the density at the point of dose which is ten-fold ($\Delta \log E = 1.0$) of the dose at the density point with fog of +0.3 is D, $\gamma = \{D-(fog+0.3)\}/1.0$.

Further, indication of characteristics with the lapse of time is shown by latent image percent at the Dmax portion of the frozen preservative to those processed at 40° C. under 80% RH for 15 days. The nearer to 100%, the more the stability increases.

As is apparent from Table 8, it is understood that Samples No. 28 to No. 33 of the present invention are extremely great in I.I.E. with respect to each color-sensitive layer as compared with the comparative samples, and a color having high chroma can be reproduced. Further, in such systems, it is clear that storability (stability with the lapse of time) which was drawback in the prior art has surprisingly improved.

TABLE 8

| Sample No. | Green-sensitive silver halide emulsion layer | | | | Red-sensitive silver halide emulsion layer | | | | Blue-sensitive silver halide emulsion layer | | | |
|---|---|---|---|---|---|---|---|---|---|---|---|---|
| | 3rd layer | | 4th layer | | 6th layer | | 7th layer | | 9th layer | | 10th layer | |
| | Em | DIR | Em | DIR | Em | DIR | Em | DIR | Em | DIR | Em | DIR |
| 25 | A | D-5 (2) | C | D-5 (1) | A | D-13 (4) | C | D-13 (1.5) | A | D-13 (6) | C | — |
| 26 | A | D-4 (1) | C | D-4 (0.4) | A | D-4 (2) | C | D-4 (0.75) | A | D-4 (5) | C | — |
| 27 | A | D-71 (1.5) | C | D-71 (0.8) | A | D-13 (4) | C | D-13 (1.5) | A | D-71 (6) | C | — |
| 28 | B | D-71 (1.5) | C | D-71 (0.8) | B | D-13 (4) | C | D-13 (1.5) | B | D-71 (6) | C | — |
| 29 | A | D-71 (1.5) | F | D-71 (0.8) | A | D-13 (4) | F | D-13 (1.5) | B | D-71 (6) | C | — |
| 30 | B | D-71 (1.5) | F | D-71 (0.8) | B | D-13 (4) | F | D-13 (1.5) | B | D-71 (6) | F | — |
| 31 | A | D-71 (1.5) | F | D-71 (0.8) | A | D-13 (4) | D | D-13 (1.5) | B | D-71 (6) | C | — |
| 32 | A | D-71 (1.5) | E | D-71 (0.9) | A | D-13 (4) | E | D-13 (1.5) | B | D-71 (6) | C | — |
| 33 | A | D-71 (1.5) | G | D-71 (0.8) | A | D-13 (4) | G | D-13 (1.5) | B | D-71 (6) | C | — |
| 34 | B | D-5 (2) | F | D-5 (1) | B | D-13 (4) | F | D-13 (1.5) | B | D-13 (6) | C | — |
| 35 | B | D-4 (1) | F | D-4 (0.4) | B | D-4 (2) | F | D-4 (0.75) | B | D-4 (5) | C | — |

| Sample No. | Photographic characteristics (I.I.E.) γA/γN | | | Characteristics with the lapse of time (40° C.-80% RH-15 days) (D processed/D unprocessed) × 100 of Dmax | | | Remark |
|---|---|---|---|---|---|---|---|
| | R | G | B | R | G | B | |
| 25 | 1.23 | 1.21 | 1.15 | 70% | 55% | 65% | Comparative |
| 26 | 1.27 | 1.30 | 1.10 | 65% | 45% | 60% | Comparative |
| 27 | 1.42 | 1.48 | 1.30 | 71% | 56% | 62% | Comparative |
| 28 | 1.52 | 1.55 | 1.37 | 82% | 80% | 91% | This invention |
| 29 | 1.58 | 1.60 | 1.36 | 93% | 91% | 90% | This invention |
| 30 | 1.64 | 1.65 | 1.40 | 98% | 96% | 94% | This invention |
| 31 | 1.63 | 1.64 | 1.37 | 94% | 96% | 92% | This invention |
| 32 | 1.63 | 1.65 | 1.38 | 95% | 95% | 93% | This invention |
| 33 | 1.60 | 1.63 | 1.37 | 94% | 97% | 91% | This invention |
| 34 | 1.30 | 1.25 | 1.18 | 75% | 57% | 66% | Comparative |
| 35 | 1.33 | 1.34 | 1.19 | 65% | 48% | 63% | Comparative |

*In the parenthesis of DIR is an added amount = $\times 10^{-3}$ mole/mole Ag.

We claim:

1. In a light-sensitive silver halide color photographic material of the type comprising two or more light-sensitive silver halide emulsion layers having different color sensitivities and being carried on a support; the improvement comprising at least one of said light-sensitive silver halide emulsion layers comprising containing twinned crystal silver halide grains;

first and second of said light-sensitive silver halide emulsion layers being different in color sensitivities and containing a first DIR compound and a second DIR compound, capable of releasing first and second developing inhibitors or developing inhibitor precursors respectively by reaction with an oxidized product of a developing agent, the developing inhibitor or developing inhibitor precursor released from each of said first and second DIR compounds having diffusiveness greater than 0.34;

said first DIR compound in said first light-sensitive layer capable of releasing said first developing inhibitor or inhibitor precursor which is operable to have a greater inhibitor influence on said second light sensitive layer than on said first light sensitive layer;

said second DIR compound in said second light sensitive layer capable of releasing said second developing inhibitor or inhibitor precursor which is operable to have a greater inhibitor influence on said first light-sensitive layer than on said second light sensitive layer; and whereby the inter-image effect of the material is improved.

2. The light-sensitive silver halide color photographic material according to claim 1, wherein said at least one of said first DIR compound and said second DIR compound is individually selected from compounds represented by the formula:

A—(Y)m wherein A represents a coupler component, m represents 1 or 2 and Y is a group which is bonded to the coupler component A at its coupling position and eliminable through the reaction with the oxidized product of a color developing agent, representing a developing inhibitor with great diffusiveness or a compound capable of releasing a developing inhibitor.

3. The light-sensitive silver halide color photographic material according to claim 2, wherein said Y in the formula is at least one selected from the group consisting of

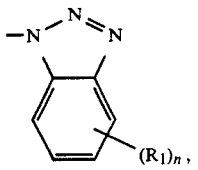

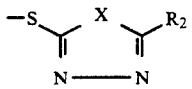

and

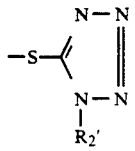

wherein each $R_1$ and $R_2$ is individually selected from the group consisting of an alkyl group, an alkoxy group, an acylamino group, a halogen atom, an alkoxycarbonyl group, a thiazolylideneamino group, an aryloxycarbonyl group, an acyloxy group, a carbamoyl group, an N-alkylcarbamoyl group, an N,N-dialkylcarbamoyl group, a nitro group, an amino group, an N-arylcarbamoyloxy group, a sulfamoyl group, an N-alkylcarbamoyloxy group, a hydroxy group, an alkoxycarbonylamino group, an alkylthio group, an arylthio group, an aryl group, a heterocyclic group, a cyano group, an alkylsulfonyl group and an aryloxycarbonylamino group; n represents 1 or 2 and, when n is 2, $R_1$ may be the same or different, and the total number of carbon atoms contained in $R_1$ in the number of n may be 0 to 10;

X represents an oxygen atom or a sulfur atom; and $R'_2$ represents an alkyl group, an aryl group or a heterocyclic group.

4. The light-sensitive silver halide color photographic material of claim 2 wherein said first DIR compound or said second DIR compound or both is a mixture of DIR compounds wherein Y is

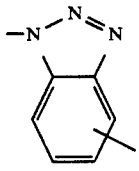

-continued

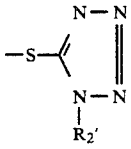

5. The light-sensitive silver halide color photographic material of claim 2, wherein said first DIR compound or said second DIR compound or both is a mixture of DIR compounds wherein Y is

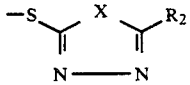

and

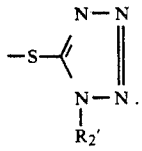

6. The light-sensitive silver halide color photographic material according to claim 1, wherein said twinned crystal silver halide grains have an aspect ratio of 8:1 or less to 2:1 or more, wherein the aspect ratio means a ratio of a diameter of grain:a thickness.

7. The light-sensitive silver halide color photographic material according to claim 6, wherein said twinned crystal silver halide grains have an aspect ratio of 6:1 or less to 2:1 or more.

8. The light-sensitive silver halide color photographic material according to claim 6, wherein an average diameter of said twinned crystal silver halide grains is from 0.2 to 5.0 μm.

9. The light-sensitive silver halide color photographic material according to claim 6, wherein said twinned crystal silver halide grains are monodispersed silver halide grains.

10. The light-sensitive silver halide color photographic material according to claim 1, wherein said silver halide grains have an average grain diameter of 0.2 to 2 μm.

11. The light-sensitive silver halide color photographic material according to claim 10, wherein said silver halide grains have an average grain diameter of 0.3 to 0.7 μm.

12. The light sensitive silver halide color photographic material according to claim 1 wherein said first light sensitive layer is a green-sensitive silver halide emulsion layer and said second light sensitive layer is a red-sensitive silver halide emulsion layer.

13. The light sensitive silver halide color photographic material according to claim 1 wherein said first light sensitive layer is a blue-sensitive silver halide emulsion layer and said second light sensitive layer is a green-sensitive silver halide emulsion layer.

14. The light sensitive silver halide color photographic material according to claim 1 wherein said first light sensitive layer is a blue-sensitive silver halide emulsion layer and said second light sensitive layer is a red-sensitive silver halide emulsion layer.

* * * * *